US009879421B2

(12) United States Patent
Pilz

(10) Patent No.: US 9,879,421 B2
(45) Date of Patent: Jan. 30, 2018

(54) FIRE-RESISTANT ANGLE AND RELATED ASSEMBLIES

(71) Applicant: California Expanded Metal Products Company, City of Industry, CA (US)

(72) Inventor: Don A. Pilz, Livermore, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 14/876,488

(22) Filed: Oct. 6, 2015

(65) Prior Publication Data

US 2016/0097197 A1 Apr. 7, 2016

Related U.S. Application Data

(60) Provisional application No. 62/060,456, filed on Oct. 6, 2014, provisional application No. 62/079,258, filed on Nov. 13, 2014.

(51) Int. Cl.
*E04B 2/74* (2006.01)
*E04B 2/82* (2006.01)

(52) U.S. Cl.
CPC ..... *E04B 2/7411* (2013.01); *E04B 2/7457* (2013.01); *E04B 2/825* (2013.01); *E04B 2002/7462* (2013.01)

(58) Field of Classification Search
CPC ..... E04B 1/948; E04B 1/9465; E04B 1/40; E04B 2/58
USPC ..... 248/300
See application file for complete search history.

(56) References Cited

U.S. PATENT DOCUMENTS

| | | | |
|---|---|---|---|
| 1,130,722 | A | 3/1915 | Fletcher |
| 1,563,651 | A | 12/1925 | Pomerantz |
| 2,105,771 | A | 1/1938 | Holdsworth |
| 2,218,426 | A | 10/1940 | Hulbert, Jr. |
| 2,683,927 | A | 7/1954 | Maronek |
| 2,733,786 | A | 2/1956 | Drake |
| 3,129,792 | A | 4/1964 | Gwynne |
| 3,271,920 | A | 9/1966 | Downing, Jr. |
| 3,309,826 | A | 3/1967 | Zinn |

(Continued)

FOREIGN PATENT DOCUMENTS

| | | |
|---|---|---|
| CA | 2234347 | 10/1999 |
| CA | 2697295 | 12/2013 |

(Continued)

OTHER PUBLICATIONS

U.S. Appl. No. 15/285,440, filed Oct. 4, 2016, Pilz.

(Continued)

*Primary Examiner* — Paola Agudelo
(74) *Attorney, Agent, or Firm* — Knobbe, Martens, Olson & Bear LLP

(57) ABSTRACT

A fire-resistance angle piece and related assemblies include at least one multi-layer portion, which can provide an insulation space and/or a sacrificial layer of the angle piece. The angle piece can comprise vent openings to a space between adjacent layers of the angle piece. In some configurations, adjacent layers of the angle piece can be sealed to one another, such as along an edge portion that can be opposite the vent openings (if present) and/or a fold of the angle piece or other closed end that creates adjacent layers. Intumescent may or may not be included on the angle piece.

11 Claims, 15 Drawing Sheets

(56) References Cited

U.S. PATENT DOCUMENTS 3,324,615 A 6/1967 Zinn
3,355,852 A 12/1967 Lally
3,397,495 A 8/1968 Thompson
3,481,090 A 12/1969 Lizee
3,537,219 A 11/1970 Navarre
3,566,559 A 3/1971 Dickson
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,908,328 A 9/1975 Nelsson
3,934,066 A 1/1976 Murch
3,935,681 A 2/1976 Voiturier et al.
3,955,330 A 5/1976 Wendt
3,964,214 A 6/1976 Wendt
3,974,607 A 8/1976 Balinski
3,976,825 A 8/1976 Anderberg
4,011,704 A 3/1977 O'Konski
4,103,463 A 8/1978 Dixon
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,203,264 A 5/1980 Kiefer et al.
4,283,892 A 8/1981 Brown
4,318,253 A 3/1982 Wedel
4,329,820 A 5/1982 Wendt
4,361,994 A 12/1982 Carver
4,424,653 A 1/1984 Heinen
4,434,592 A 3/1984 Reneault et al.
4,437,274 A 3/1984 Slocum et al.
4,454,690 A 6/1984 Dixon
4,622,794 A 11/1986 Geortner
4,649,089 A 3/1987 Thwaites
4,672,785 A 6/1987 Salvo
4,709,517 A 12/1987 Mitchell et al.
4,711,183 A * 12/1987 Handler ..... A47B 57/402 108/107
4,723,385 A 2/1988 Kallstrom
4,761,927 A 8/1988 O'Keeffe et al.
4,787,767 A 11/1988 Wendt
4,805,364 A 2/1989 Smolik
4,825,610 A 5/1989 Gasteiger
4,845,904 A 7/1989 Menchetti
4,850,385 A 7/1989 Harbeke
4,885,884 A 12/1989 Schilger
4,918,761 A 4/1990 Harbeke
4,930,276 A 6/1990 Bawa et al.
5,010,702 A * 4/1991 Daw ..... E04B 2/82 52/241
5,094,780 A 3/1992 von Bonin
5,103,589 A 4/1992 Crawford
5,125,203 A 6/1992 Daw
5,127,203 A * 7/1992 Paquette ..... E04H 3/02 52/241
5,127,760 A 7/1992 Brady
5,146,723 A 9/1992 Greenwood et al.
5,155,957 A 10/1992 Robertson et al.
5,157,883 A 10/1992 Meyer
5,167,876 A 12/1992 Lem
5,173,515 A 12/1992 von Bonin et al.
5,212,914 A 5/1993 Martin et al.
5,222,335 A 6/1993 Petrecca
5,244,709 A 9/1993 Vanderstukken
5,285,615 A 2/1994 Gilmour
5,315,804 A 5/1994 Attalla
5,325,651 A 7/1994 Meyer et al.
5,347,780 A 9/1994 Richards et al.
5,367,850 A 11/1994 Nicholas
5,374,036 A 12/1994 Rogers et al.
5,376,429 A 12/1994 McGroarty
5,390,465 A 2/1995 Rajecki
5,394,665 A 3/1995 Johnson
5,412,919 A 5/1995 Pellock et al.
5,452,551 A 9/1995 Charland et al.
5,454,203 A 10/1995 Turner
5,456,050 A 10/1995 Ward
5,471,791 A 12/1995 Keller
5,471,805 A 12/1995 Becker
5,477,652 A 12/1995 Torrey et al.
5,552,185 A 9/1996 De Keyser
5,592,796 A 1/1997 Landers
5,604,024 A 2/1997 von Bonin
5,644,877 A 7/1997 Wood
5,687,538 A 11/1997 Frobosilo et al.
5,689,922 A 11/1997 Daudet
5,709,821 A 1/1998 von Bonin et al.
5,740,643 A 4/1998 Huntley
5,755,066 A 5/1998 Becker
5,765,332 A 6/1998 Landin et al.
5,787,651 A * 8/1998 Horn ..... E04B 2/7412 52/144
5,797,233 A 8/1998 Hascall
5,806,261 A 9/1998 Huebner et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,950,385 A 9/1999 Herren
5,968,615 A 10/1999 Schlappa
5,968,669 A 10/1999 Liu et al.
5,974,750 A 11/1999 Landin et al.
5,974,753 A * 11/1999 Hsu ..... E04F 13/0862 52/287.1
6,058,668 A 5/2000 Herren
6,110,559 A 8/2000 De Keyser
6,116,404 A 9/2000 Heuft et al.
6,128,874 A 10/2000 Olson et al.
6,131,352 A 10/2000 Barnes et al.
6,151,858 A 11/2000 Ruiz et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,305,133 B1 10/2001 Cornwall
6,374,558 B1 4/2002 Surowiecki
6,381,913 B2 5/2002 Herren
6,405,502 B1 6/2002 Cornwall
6,430,881 B1 8/2002 Daudet et al.
6,470,638 B1 10/2002 Larson
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,698,146 B2 3/2004 Morgan et al.
6,705,047 B2 3/2004 Yulkowski
6,732,481 B2 5/2004 Stahl, Sr.
6,783,345 B2 8/2004 Morgan et al.
6,799,404 B2 10/2004 Spransy
6,843,035 B1 1/2005 Glynn
6,854,237 B2 2/2005 Surowiecki
6,871,470 B1 3/2005 Stover
7,043,880 B2 5/2006 Morgan et al.
7,059,092 B2 6/2006 Harkins et al.
7,104,024 B1 9/2006 deGirolamo et al.
7,152,385 B2 12/2006 Morgan et al.
7,191,845 B2 3/2007 Loar
7,240,905 B1 7/2007 Stahl
7,251,918 B2 * 8/2007 Reif ..... E04F 13/0844 52/582.1
7,302,776 B2 12/2007 Duncan et al.
7,398,856 B2 7/2008 Foster et al.

(56) References Cited

U.S. PATENT DOCUMENTS

| | | | | |
|---|---|---|---|---|
| 7,413,024 | B1 | 8/2008 | Simontacchi et al. | |
| 7,487,591 | B2 | 2/2009 | Harkins et al. | |
| 7,506,478 | B2 | 3/2009 | Bobenhausen | |
| 7,513,082 | B2 | 4/2009 | Johnson | |
| 7,540,118 | B2 | 6/2009 | Jensen | |
| 7,617,643 | B2 | 11/2009 | Pilz et al. | |
| 7,681,365 | B2 | 3/2010 | Klein | |
| 7,685,792 | B2 | 3/2010 | Stahl, Sr. et al. | |
| 7,716,891 | B2 | 5/2010 | Radford | |
| 7,752,817 | B2 | 7/2010 | Pilz et al. | |
| 7,775,006 | B2 | 8/2010 | Giannos | |
| 7,776,170 | B2 | 8/2010 | Yu et al. | |
| 7,797,893 | B2 | 9/2010 | Stahl, Sr. et al. | |
| 7,810,295 | B2 | 10/2010 | Thompson | |
| 7,814,718 | B2 | 10/2010 | Klein | |
| 7,827,738 | B2 | 11/2010 | Abrams et al. | |
| 7,866,108 | B2 | 1/2011 | Klein | |
| 7,950,198 | B2 | 5/2011 | Pilz et al. | |
| 8,056,293 | B2 | 11/2011 | Klein | |
| 8,061,099 | B2 | 11/2011 | Andrews | |
| 8,062,108 | B2 | 11/2011 | Carlson et al. | |
| 8,069,625 | B2 | 12/2011 | Harkins et al. | |
| 8,074,416 | B2 | 12/2011 | Andrews | |
| 8,087,205 | B2 | 1/2012 | Pilz et al. | |
| 8,100,164 | B2 | 1/2012 | Goodman et al. | |
| 8,132,376 | B2 | 3/2012 | Pilz et al. | |
| 8,136,314 | B2 | 3/2012 | Klein | |
| 8,151,526 | B2 | 4/2012 | Klein | |
| 8,181,404 | B2 | 5/2012 | Klein | |
| 8,225,581 | B2 | 7/2012 | Strickland et al. | |
| 8,281,552 | B2 | 10/2012 | Pilz et al. | |
| 8,322,094 | B2 | 12/2012 | Pilz et al. | |
| 8,353,139 | B2 | 1/2013 | Pilz | |
| 8,413,394 | B2 | 4/2013 | Pilz et al. | |
| 8,495,844 | B1 | 7/2013 | Johnson | |
| 8,499,512 | B2 | 8/2013 | Pilz et al. | |
| 8,555,566 | B2 | 10/2013 | Pilz et al. | |
| 8,578,672 | B2 | 11/2013 | Mattox et al. | |
| 8,590,231 | B2 | 11/2013 | Pilz | |
| 8,595,999 | B1 | 12/2013 | Pilz et al. | |
| 8,596,019 | B2 * | 12/2013 | Aitken | E04B 2/7457 52/710 |
| 8,607,519 | B2 | 12/2013 | Hilburn | |
| 8,640,415 | B2 | 2/2014 | Pilz et al. | |
| 8,646,235 | B2 | 2/2014 | Hilburn, Jr. | |
| 8,671,632 | B2 | 3/2014 | Pilz et al. | |
| 8,728,608 | B2 | 5/2014 | Maisch | |
| 8,793,947 | B2 | 8/2014 | Pilz et al. | |
| 8,938,922 | B2 | 1/2015 | Pilz et al. | |
| 8,973,319 | B2 | 3/2015 | Pilz et al. | |
| 9,045,899 | B2 | 6/2015 | Pilz et al. | |
| 9,127,454 | B2 | 9/2015 | Pilz et al. | |
| 9,206,596 | B1 | 12/2015 | Robinson | |
| 9,290,932 | B2 | 3/2016 | Pilz et al. | |
| 9,290,934 | B2 | 3/2016 | Pilz et al. | |
| 9,371,644 | B2 | 6/2016 | Pilz et al. | |
| 9,458,628 | B2 | 10/2016 | Pilz et al. | |
| 9,481,998 | B2 | 11/2016 | Pilz et al. | |
| 9,512,614 | B2 | 12/2016 | Klein et al. | |
| 9,523,193 | B2 | 12/2016 | Pilz | |
| 9,551,148 | B2 | 1/2017 | Pilz | |
| 9,616,259 | B2 | 4/2017 | Pilz et al. | |
| 9,637,914 | B2 | 5/2017 | Pilz et al. | |
| 2002/0029535 | A1 | 3/2002 | Loper | |
| 2002/0160149 | A1 | 10/2002 | Garofalo | |
| 2002/0170249 | A1 | 11/2002 | Yulkowski | |
| 2003/0079425 | A1 | 5/2003 | Morgan et al. | |
| 2003/0089062 | A1 | 5/2003 | Morgan et al. | |
| 2003/0213211 | A1 | 11/2003 | Morgan et al. | |
| 2004/0010998 | A1 | 1/2004 | Turco | |
| 2004/0016191 | A1 | 1/2004 | Whitty | |
| 2004/0045234 | A1 | 3/2004 | Morgan et al. | |
| 2004/0139684 | A1 | 7/2004 | Menendez | |
| 2004/0211150 | A1 | 10/2004 | Bobenhausen | |
| 2005/0183361 | A1 * | 8/2005 | Frezza | E02D 27/00 52/293.3 |
| 2005/0246973 | A1 | 11/2005 | Jensen | |
| 2006/0032163 | A1 | 2/2006 | Korn | |
| 2006/0123723 | A1 | 6/2006 | Weir et al. | |
| 2006/0137293 | A1 * | 6/2006 | Klein | E04B 2/7411 52/782.1 |
| 2007/0056245 | A1 | 3/2007 | Edmondson | |
| 2007/0068101 | A1 | 3/2007 | Weir et al. | |
| 2007/0130873 | A1 | 6/2007 | Fisher | |
| 2007/0193202 | A1 | 8/2007 | Rice | |
| 2007/0261343 | A1 | 11/2007 | Stahl, Sr. | |
| 2008/0087366 | A1 | 4/2008 | Yu et al. | |
| 2008/0134589 | A1 | 6/2008 | Abrams et al. | |
| 2008/0172967 | A1 | 7/2008 | Hilburn | |
| 2008/0250738 | A1 | 10/2008 | Howchin | |
| 2011/0041415 | A1 | 2/2011 | Esposito | |
| 2011/0056163 | A1 | 3/2011 | Kure | |
| 2011/0067328 | A1 | 3/2011 | Naccarato et al. | |
| 2011/0099928 | A1 | 5/2011 | Klein et al. | |
| 2011/0146180 | A1 | 6/2011 | Klein | |
| 2011/0167742 | A1 | 7/2011 | Klein | |
| 2011/0185656 | A1 | 8/2011 | Klein | |
| 2011/0214371 | A1 | 9/2011 | Klein | |
| 2012/0023846 | A1 | 2/2012 | Mattox et al. | |
| 2012/0247038 | A1 | 10/2012 | Black | |
| 2012/0266550 | A1 | 10/2012 | Naccarato et al. | |
| 2012/0297710 | A1 | 11/2012 | Klein | |
| 2013/0086859 | A1 | 4/2013 | Pilz | |
| 2013/0186020 | A1 * | 7/2013 | Pilz | E04B 2/7411 52/232 |
| 2014/0219719 | A1 | 8/2014 | Hensley et al. | |
| 2015/0135631 | A1 | 5/2015 | Foerg | |
| 2015/0275510 | A1 | 10/2015 | Klein et al. | |
| 2016/0017599 | A1 * | 1/2016 | Klein | E04B 2/7411 52/232 |
| 2016/0130802 | A1 | 5/2016 | Pilz | |
| 2016/0208484 | A1 | 7/2016 | Pilz | |
| 2016/0265219 | A1 | 9/2016 | Pilz | |
| 2016/0296775 | A1 | 10/2016 | Pilz | |
| 2017/0016227 | A1 | 1/2017 | Klein | |
| 2017/0044762 | A1 | 2/2017 | Pilz | |
| 2017/0130445 | A1 | 5/2017 | Pilz | |
| 2017/0191261 | A9 | 7/2017 | Pilz et al. | |

FOREIGN PATENT DOCUMENTS

| | | |
|---|---|---|
| CA | 2736834 | 12/2015 |
| EP | 0 346 126 | 12/1989 |
| GB | 2 159 051 | 11/1985 |
| GB | 2 411 212 | 8/2005 |
| JP | 06-146433 | 5/1994 |
| JP | 06-220934 | 8/1994 |
| WO | WO 2003/038206 | 5/2003 |
| WO | WO 2007/103331 | 9/2007 |
| WO | WO 2009/026464 | 2/2009 |

OTHER PUBLICATIONS

U.S. Appl. No. 15/411,374, filed Jan. 20, 2017, Pilz.

BlazeFrame 2009 catalog of products, available at least as of Mar. 4, 2010 from www.blazeframe.com, in 20 pages.

Canadian First Office Action for Application No. 2,697,295, dated Sep. 21, 2011, in 4 pages.

Canadian Second Office Action for Application No. 2,697,295, dated May 23, 2012, in 4 pages.

Canadian Office Action for Application No. 2,827,183, dated Mar. 27, 2015 in 4 pages.

Canadian Office Action for Application No. 2,827,183, dated Mar. 7, 2016 in 4 pages.

Catalog page from Stockton Products, printed from www.stocktonproducts.com, on Dec. 16, 2007, showing #5 Drip, in 1 page.

ClarkDietrich Building Systems, Product Submittal Sheet, (FTSC) Flat Trail Vertical Slide Clip. CD-FTSC11 07/11. 1 page.

DoubleTrackTM information sheets by Dietrich Metal Framing, in 2 pages; accessible on Internet Wayback Machine on Jul. 8, 2006.

(56) References Cited

OTHER PUBLICATIONS

FireStikTM by CEMCO Brochure, published on www.firestik.us, in 18 pages; accessible on Internet Wayback Machine on Aug. 13, 2007.
Information Dislosure Statement letter; U.S. Appl. No. 12/196,115, dated Aug. 4, 2011.
International Search Report for Application No. PCT/US2008/073920, dated Apr. 9, 2009.
James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
U.S. Appl. No. 15/462,671, filed Mar. 17, 2017, Pilz.
U.S. Appl. No. 15/469,370, filed Mar. 24, 2017, Pilz et al.
U.S. Appl. No. 15/481,272, filed Apr. 6, 2017, Pilz.
"Intumescent Expansion Joint Seals", Astroflame; http://www.astroflame.com/intumescent_expansion_joint_seals; Jul. 2011; 4 pages.
"System No. HW-D-0607", May 6, 2010, Metacaulk, www.rectorseal.com, www.metacault.com; 2008 Underwriters Laboratories Inc.; 2 pages.
U.S. Appl. No. 15/655,688, filed Jul. 20, 2017, Pilz.

* cited by examiner

FIRE-RESISTANT ANGLE AND RELATED ASSEMBLIES

INCORPORATION BY REFERENCE TO ANY PRIORITY APPLICATIONS

Any and all applications for which a foreign or domestic priority claim is identified in the Application Data Sheet as filed with the present application are hereby incorporated by reference in their entirety.

BACKGROUND

Field

The disclosure generally relates to fire-rated building structures. In particular, the disclosure relates to fire-rated joint systems, wall assemblies, and other building structures that incorporate the fire-rated joint systems.

Description of the Related Art

Fire-rated construction components and assemblies are commonly used in the construction industry. These components and assemblies are aimed at inhibiting or preventing fire, heat, and smoke from leaving one room or other portion of a building and entering another room or portion of a building. The fire, heat or smoke usually moves between rooms through vents, joints in walls, or other openings. The fire-rated components often incorporate fire-retardant materials which substantially block the path of the fire, heat or smoke for at least some period of time. Intumescent materials work well for this purpose, because they swell and char when exposed to flames helping to create a barrier to the fire, heat, and/or smoke.

One particular wall joint with a high potential for allowing fire, heat or smoke to pass from one room to another is the joint between the top of a wall and the ceiling, which can be referred to as a head-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages that are described herein.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and at least one flange extending from the web. Typically, the header track includes a pair of flanges, which extend in the same direction from opposing edges of the web. The header track can be slotted header track, which includes a plurality of slots spaced along the length of the track and extending in a vertical direction. When the wall studs are placed into the slotted track, each of the plurality of slots accommodates a fastener used to connect the wall stud to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, as described above.

Recently, improved methods of providing a fire-rated head-of-wall joint have been developed. One example of a fire-rated wall construction component is a head-of-wall fire block device sold by the Assignee of the present application under the trademark FireStik®. The FireStik® fire block product incorporates a metal profile with a layer of intumescent material on its inner surface. The metal profile of the FireStik® fire block product is independently and rigidly attached to a structure, such as the bottom of a floor or ceiling, at a position adjacent to the gap between the wallboard (e.g., drywall) and the ceiling on the opposite side (i.e., outside) of the wallboard relative to the studs and header track. The intumescent material, which is adhered to the inner surface of the metal profile, faces the wallboard, stud and header track. The space created in between the wallboard and ceiling, and the space between the stud and header track, allows for independent vertical movement of the stud in the header track when no fire is present.

When temperatures rise, the intumescent material on the FireStik® fire block product expands rapidly and chars. This expansion creates a barrier which fills the head-of-wall gap and inhibits or at least substantially prevents fire, heat and smoke from moving through the head-of-wall joint and entering an adjacent room for at least some period of time.

Still another example of an improved construction component for creating a fire-rated head-of-wall joint is a header track with integrated intumescent material strips sold by the Assignee of the present application under the trademark FAS Track®. In contrast to the FireStik® fire block product, the FAS Track® header track product incorporates the intumescent material directly on the header track so that the fire block material is installed during the framing process. Both the FireStik® and the FAS Track® fire block products are typically installed by the framing crew. The integration of the intumescent material into the FAS Track® header track product eliminates the need to install an additional fire block product after the wall board has been installed, which is typically done by a different crew than the framing crew.

SUMMARY

Although the FireStik® and the FAS Track® products represent an improvement over the conventional method of stuffing mineral wool material into the head-of-wall joint and applying the elastomeric spray material over the mineral wool, there still exists room for improved or alternative products and methods for efficiently and cost-effectively creating fire-rated wall joints. One such product is a fire-rated angle piece that incorporates a fire-resistant or intumescent material on at least one surface of the angle piece, is separate from the header track, but is configured to be installed prior to the installation of the wall board and, preferably, during the framing process. Such an internal fire-rated angle is manufactured and sold by the Applicant under the trade name Deflection Drift Angle (DDA™).

Advantageously, the Deflection Drift Angle DDA™ piece can be installed along with the installation of the header track or can be installed after the installation of the header track. Such an arrangement avoids the need to have the framers return after the installation of the wall board to install fire sealant in the gap between the edge of the wall board and the overhead structure. In addition, the Deflection Drift Angle DDA™ piece can be stacked and shipped without damaging the intumescent material more easily than a header track that incorporates the intumescent material.

A need still exists for improved or alternative angle pieces and related assemblies. The systems, methods and devices described herein have innovative aspects, no single one of which is indispensable or solely responsible for their desirable attributes. Without limiting the scope of the claims, some of the advantageous features will now be summarized.

At least some embodiments of the angle pieces and related assemblies disclosed herein include at least one multi-layer portion, which can provide an insulation space and/or a sacrificial layer of the angle piece. The angle piece can comprise vent openings to a space between adjacent layers of the angle piece. In some configurations, adjacent layers of the angle piece can be sealed to one another, such as along an edge portion that can be opposite the vent openings (if present) and/or a fold of the angle piece or other closed end that creates adjacent layers. Intumescent may or may not be included.

In some configurations, a fire-rated wall joint product includes an elongated, generally L-shaped angle piece comprising a first flange and a second flange oriented at an angle relative to the first flange, the first flange and the second flange each having a free edge and being connected to one another along an edge that is opposite the free edges thereby defining a corner, the first flange and second flange formed from a single piece of material, wherein one of the first flange and the second flange comprises multiple layers of material. In some configurations, the first flange is a single layer and the second flange is multi-layer, further comprising an intumescent material strip applied to an interior surface of the first flange. In some configurations, a width of the intumescent material strip is less than about a width of the first flange. In some configurations, the multi-layer flange is constructed from a single piece of material. In some configurations, the fire-rated wall joint product further includes a plurality of vent openings communicating with an insulation space between the layers of the multi-layer flange. In some configurations, the fire-rated wall joint product further includes a seal between adjacent layers of the multi-layer flange.

In some configurations, the multi-layer flange is a two-layer flange constructed from a single piece of material having a bend, and wherein the seal is at an opposite end portion from the bend. In some configurations, the first flange is bent to create an offset upper portion and lower portion. In some configurations, the second flange is multi-layer and comprises a rib or protrusion along an upper portion of the inside layer such that, in use, the rib or protrusion spaces the second flange from a leg of an associated header track with which the fire-rated wall joint product is used. In some configurations, the product is constructed from steel with or without a fire-retardant material, such as sealant, intumescent tape or intumescent paint.

In another configuration, a fire-rated wall assembly includes a track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section, at least one wallboard, an elongated, generally L-shaped angle piece comprising a first flange and a second flange oriented at an angle relative to the first flange, the first flange and the second flange each having a free edge and being connected to one another along an edge that is opposite the free edges thereby defining a corner, the first flange and second flange formed from a single piece of material, wherein one of the first flange and the second flange comprises multiple layers of material, and in use, the angle piece is positioned between the track and the wallboard. In some configurations, the angle piece is also positioned between the header track and an overhead structure.

In yet another configuration, a fire-rated wall joint product includes an elongated, generally T-shaped angle piece comprising a first flange, a second flange, and a third flange, the second flange oriented at an angle relative to the first flange and the third flange, the first flange and the third flange each having a free edge and being connected to one another along an edge that is opposite the free edges thereby defining two corners, the first flange, the second flange, and the third flange formed from a single piece of material, wherein the second flange comprises multiple layers of material. In some configurations, the wall joint product further includes a fourth flange connected to the third flange, the fourth flange oriented at an angle to the third flange thereby defining a corner, wherein, in use, the fourth flange is in contact with an outside surface of a wallboard. In some configurations, a firestopping material is applied to an outer surface of the fourth flange. In some configurations, the T-shaped angle piece is formed from a single piece of sheet steel. In some configurations, the T-shaped angle piece is formed from two pieces of sheet steel. In some configurations, the two pieces of sheet steel are connected by an interlocking connection comprising a first interlocking portion formed from a free end of the third flange and a second interlocking portion formed from a free end of the fourth flange. In some configurations, the fourth flange further comprises a kickout portion to allow a wallboard to be inserted between an inner surface of the fourth flange and an outer surface of the second flange.

In yet another configuration, a method of assembling a fire-rated wall joint includes securing a header track to a ceiling, positioning a first horizontal leg of an elongated, generally T-shaped fire-rated angle piece between the header track and the ceiling, positioning a plurality of studs into the header track, securing at least one wall board member to the plurality of studs such that a first vertical leg of the angle piece is positioned between the at least one wall board member and the header track and a second vertical leg of the angle piece is positioned outward of the at least one wall board, and applying a fireblocking material to an outside surface of the second vertical leg of the angle piece.

In some configurations, the fire-rated wall joint product may be formed from a single piece of sheet steel that is bent pressed or roll formed. In some configurations, the other leg of the fire-rated wall joint product may be in contact with the drywall or wallboard to the hold the drywall or wallboard in place during a fire test event. In some configurations, a kickout portion of the fire-rated wall joint product can allow the drywall to slide up under the back surface of the outer leg without restriction, while still providing unencumbered movement. In some configurations, the outer surface of the outer leg of the fire-rated wall joint product provides a surface for the fire spray application prior to drywall installation. In some configurations, the outer surface of the outer leg of the fire-rated wall joint product provides the ability to install a pre-manufactured firestopping system. In some configurations, the outer surface of the fire-rated wall joint product provides a location for firestop to be applied prior to the installation of the surface drywall. In some configurations, optional fire block material can be factory applied between inside facing and outside facing legs of the fire-rated wall joint product. In some configurations, the fire-rated wall joint product can include a friction fit horizontal leg for ease of installation. In other configurations, the fire-rated wall joint product does not include a friction fit horizontal leg. In some configurations, a fire-rated wall joint product having a J-profile can be mechanically fastened to a leg of the header track of a wall assembly.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings. Any dimensions disclosed in the drawings or elsewhere herein are for the purpose of illustration only.

DETAILED DESCRIPTION

Figure 1:
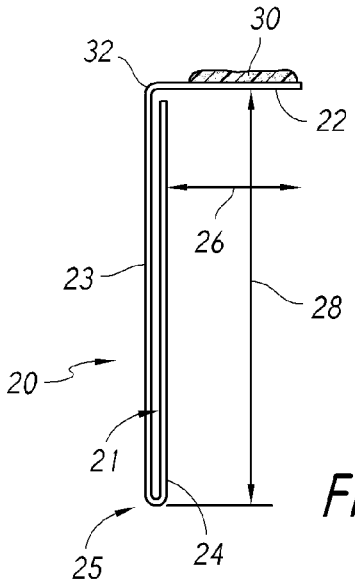
FIG. 1 illustrates a cross-sectional view of a fire-block angle piece.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back,"

"left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

The angle pieces and related assemblies disclosed herein are used in a manner similar to the Deflection Drift Angle DDA™ pieces/assemblies disclosed in Applicant's U.S. Pat. No. 8,595,999, the entirety of which is incorporated by reference herein. In some configurations, the angle pieces are assembled in a wall assembly with a portion of the angle piece between the header track and the wallboard. However, the angle pieces can find utility in other applications, as well.

Figure 2:
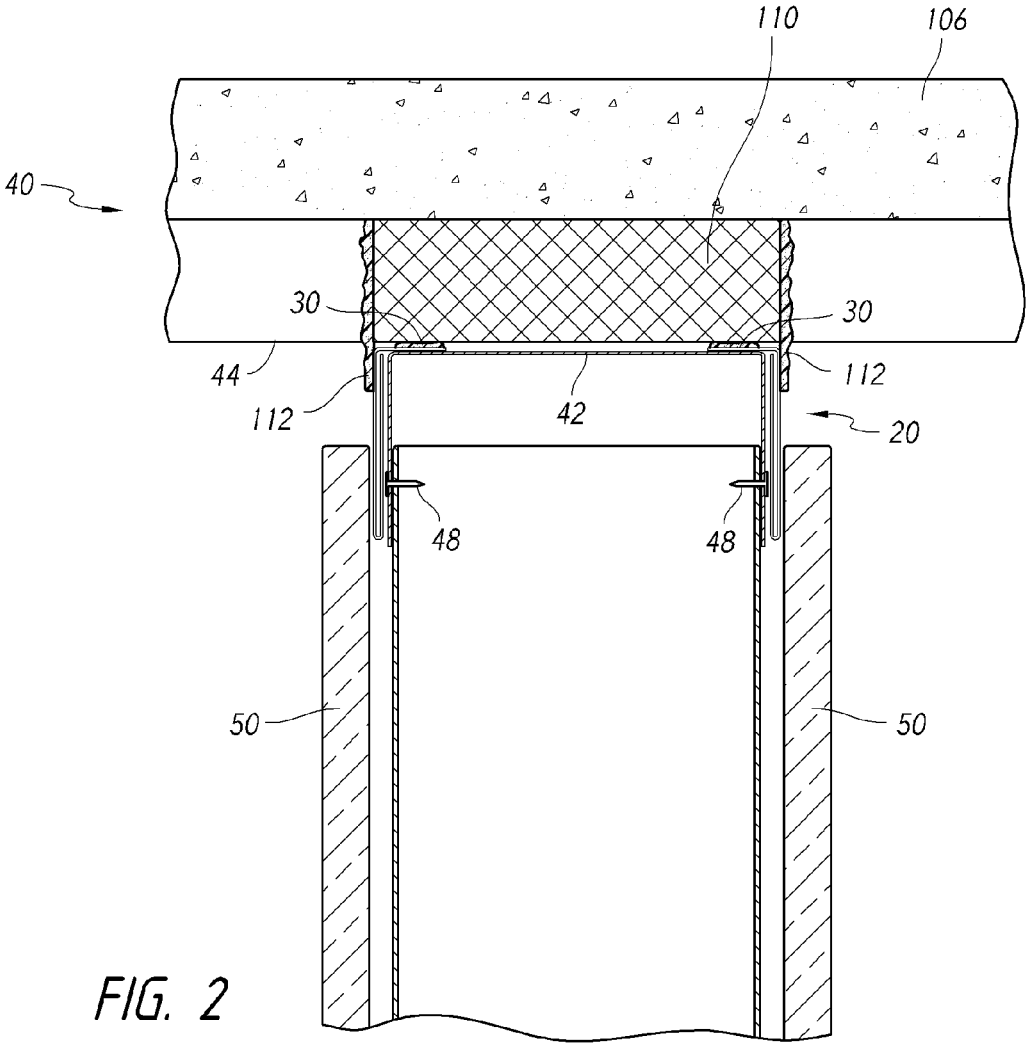
FIG. 2 illustrates a cross-sectional view of a head-of-wall joint incorporating the fire-block angle piece of FIG. 1.

FIGS. 1 and 2 illustrate an embodiment of a fire-rated profile or angle piece 20, which is also referred to herein simply as an angle 20, alone (FIG. 1) and incorporated into a head-of-wall assembly (FIG. 2). With reference to FIG. 1, an angle piece 20 is similar to the Deflection Drift Angle DDA™ piece except the intumescent material is removed from the leg adjacent the wallboard. Optionally, intumescent material of any suitable type (e.g., tape or paint or sealant) can be positioned on the leg that is captured between the header track and the ceiling element. The intumescent can be positioned on an outer surface (facing away from the header track when assembled) of the angle piece. In some configurations, additional intumescent material strips or layers can be provided.

The angle 20 preferably is formed from a light gauge steel material by any suitable process, such as roll forming, for example. Preferably, the angle 20 is an elongated member having a consistent or substantially consistent cross-sectional shape throughout its length. One or more preferred embodiments of the angle 20 are generally or substantially L-shaped in cross-section. In one embodiment, the angle 20 may be between about 5 feet and 25 feet in length. The angle 20 can be between about 10 and 20 feet in length. Preferably, the angle 20 is about 10-12 feet in length to facilitate shipping and storage. Desirably, the angle 20 is sufficiently long to allow installation along a wall with a relatively small number of pieces. However, the length of the angle 20 should be short enough that shipping and material handling is relatively convenient. Accordingly, the above-recited lengths are presently preferred. However, other lengths may also be used in other situations.

Preferably, the angle 20 includes a top or upper wall portion or top or upper leg or flange 22. The upper wall portion 22 is also referred to herein as a horizontal leg because it is typically oriented in a horizontal or substantially horizontal plane when installed in a head-of-wall assembly, as described herein. In some configurations, the angle piece 20 comprises a multi-layer vertical leg portion 25. As shown in FIG. 1, the vertical leg portion 25 includes an interior side wall portion 24 and an exterior side wall portion 23, which are also referred to herein as a vertical leg or flange because they are typically oriented in a vertical or substantially vertical plane when the angle 20 is installed in a head-of-wall assembly.

For example, the vertical leg portion 25 that is adjacent the flange of the header track or wallboard can comprise multiple layers (e.g., 2, 3, 4 or more layers). Adjacent layers can create a space 21 therebetween, which can function as an insulation space to create an insulation effect, like a dual pane window. One or more of the layers can define a sacrificial layer that can be sacrificed in the event of a fire to preserve or delay damage to the underlying wall assembly, such as the header track, for example. The term "sacrificial layer" is a term used in construction and can refer to a layer of protection that can sacrificed or destroyed in order to maintain the integrity of another structure, such as the wall assembly.

Figure 5:
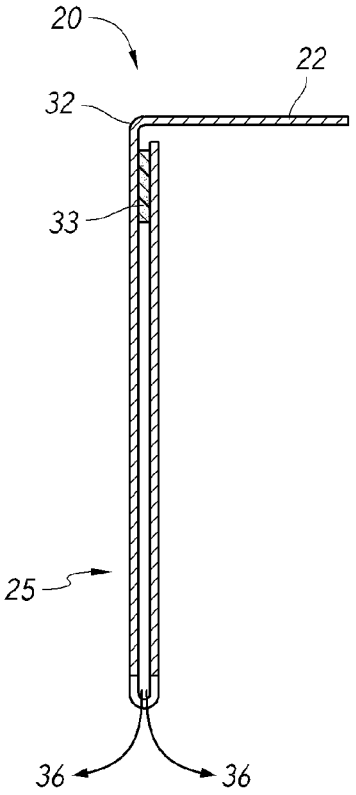
FIG. 5 illustrates a cross-sectional view of yet another fire-block angle piece having a vent and a seal arrangement.
Figure 6:
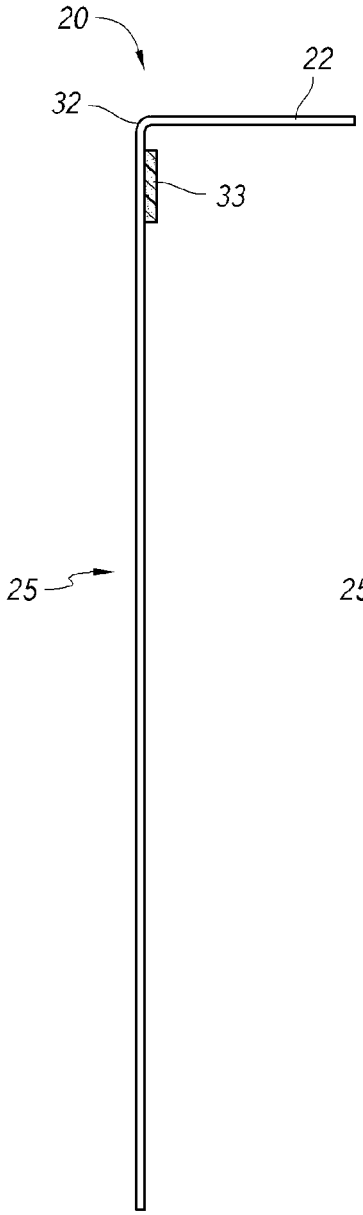
FIG. 6 illustrates the fire-block angle piece of FIG. 5 in one state of manufacture.
Figure 7:
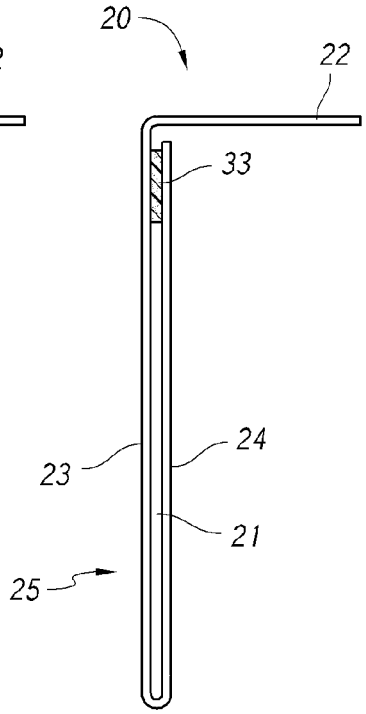
FIG. 7 illustrates the fire-block angle piece of FIG. 5 in another state of manufacture.

In some configurations, the multi-layer vertical leg portion 25 of the angle 20 is created by folding a section of material to create two (or more) adjacent layers, as shown in FIGS. 5-7. In some configurations, the entire angle piece 20 is created from a single material piece that is folded by any suitable method (e.g., roll forming or bending) to create a first leg and a multi-layered second leg. The angle piece 20 can be a steel angle with one short leg 22 that is friction (or otherwise) fit between the web of the framing member (e.g., header track) and the overhead or adjoining building structure (e.g., ceiling or deck pan) and a longer leg that is bent over to form a 90 degree angle to the short leg. When the long leg is bent over it forms a single leg that has at least two layers of steel. The two layers of steel will provide an insulating effect when introduced to fire. In some configurations, the outer layer 23 of the multi-layer vertical leg portion 25 that is exposed closest to the fire will buckle and create a separation between the first and second layer of steel. This will allow the inner steel leg 24 to remain cooler and reduce or prevent the transfer of heat from one side of the wall to the other.

The multi-layer portion 25 is unitarily formed with the horizontal leg 22. That is, the horizontal leg 22 and the vertical legs 23, 24 are constructed from a single piece of material. As described above, typically, the single piece of material is a flat piece of light gauge steel, which is then deformed into the shape of the angle 20, such as through a roll-forming, bending (such as on a press brake) or other suitable process. Preferably, both the horizontal leg 22 and the vertical leg 25 are substantially planar and define an angle therebetween of about 90 degrees or, in some arrangements, slightly less than 90 degrees. For example, the legs 22 and 25 may define an angle of between about 80 degrees and about 90 degrees, between about 85 degrees and 90 degrees or about 87 degrees. This can assist in providing a gap at the upper end of the vertical leg 25 to accommodate a fastener head, as is described in greater detail below.

In some configurations, an intumescent material, such as paint, tape, or sealant can be applied to the leg 25 prior to being bent so that the intumescent material is layered, sandwiched, or compressed between the two or more layers of steel (that is, between legs 23 and 24), as shown in FIGS. 5-7. The intumescent material can have any suitable height, width, length and thickness dimension. Preferably, the intumescent material extends an entire length of the angle piece 20. In some cases, it can be desirable to reduce the amount of intumescent material used because the material can be costly. For example, it may be desirable to reduce the amount of intumescent tape used, such that the width/height of the tape is less than the width/height of the leg upon which the intumescent tape is applied. Intumescent paint, for example, may be more cost effective and, thus, may cover a greater area of the leg, such as an entire area of the leg. Other fire-blocking or fire-retardant materials could be used in place of intumescent materials.

In some configurations, intumescent 30 can be applied to the short or upper leg 22 so that the intumescent 30 is layered and compressed between the angle 20 and the adjoining structure 44, as shown in FIGS. 1 and 2. The adjoining structure can be a ceiling or overhead structure, for example. Such intumescent can seal a gap between the header track and the ceiling or other overhead structure in the event of a fire.

In one embodiment of the light gauge steel angle 20, as shown in FIG. 1, the horizontal leg 22 can define a width 26 (i.e., horizontal cross-sectional dimension) of about ¾ inch or less, 1 inch or less, or 1½ inches or less. Preferably, the horizontal leg 22 is about 1½ inches wide. The vertical leg portion 25 can define a width or height 28 (i.e., vertical cross-sectional dimension) between about ½ inch and about 3 inches or more depending on amount of fire and smoke protection desired and/or based on deflection requirements. The dimensions of the width of the horizontal leg 22 preferably are selected such that two angles 20 can be employed in a head-of-wall assembly (illustrated in FIG. 1A) with one angle 20 on each side of the wall. Preferably, the width of the horizontal leg 22 is selected such that the legs 22 of the two angles 20 do not overlap one another when assembled into the head-of-wall assembly. Accordingly, if the angle 20 is configured for use with a wall assembly that is wider than standard width, the width of the horizontal leg 22 can be increased to, for example, about 1½ inches to about 3 inches, or more. The width or height of the vertical leg 25 is selected such that the leg 25 preferably fills the entire head-of-wall gap, or gap between the ceiling and upper end surfaces of the wall board, in an open-most position of the head-of-wall joint (assuming a dynamic joint). Alternatively, the width or height of the vertical leg 25 is selected to cover a substantial portion, such as ⅓ to ½ or more, of the corresponding leg of the header track. Thus, the actual width or height of the vertical leg 25 can vary from the exemplary widths or heights described herein.

FIG. 2 illustrates a wall assembly 40 (in particular, a head-of-wall assembly) including an embodiment of the angle 20 installed on each side of a header track 42. The intumescent strip 30 on the angle 20 is compressed between the header track 42 and an overhead structure/ceiling 44 creating a gasket to protect against smoke, fire and sound passing through the gap between the header track 42 and the ceiling 44. In the illustrated arrangement, the ceiling 44 is a fluted pan deck. However, the angle 20 can be employed with other types of overhead structures, including a concrete deck. The wall assembly 40 also includes a plurality of wall studs 46 (only one is shown), which are coupled to the header track 42 by suitable fasteners 48 (e.g., ½ inch framing screws). The header track 42 can be a slotted header track, which allows vertical movement of the wall studs 46 relative to the header track 42. Wall board members 50 (e.g., drywall) are coupled to the wall studs 46 by suitable fasteners (not shown) and, thus, can move along with the wall studs 46 relative to the header track 42. In FIG. 2, a metal stud framed wall assembly 40 is attached to a ceiling 44 in the form of a fluted pan deck. The fluted pan deck includes a pan, which defines downwardly-opening spaces, voids or flutes, and a layer of concrete 106 supported by the pan. In the illustrated arrangement, the wall assembly 40 is oriented perpendicular or substantially perpendicular to the flutes of the fluted pan deck. Fire-rated walls require fire-resistant material, such as mineral wool 110, to be installed within the voids of the fluted pan deck when the wall assembly 40 is running perpendicular to the flutes. The voids or flutes of a fluted pan deck vary in size but generally are about 7½ inches by 3 inches. Mineral wool 110 is compressed and placed into these voids. A fire spray material 112 (e.g., a fire-resistant elastomeric material that can be applied with a sprayer) is then sprayed over the top of the mineral wool 110 to protect against smoke passage. The fire spray 112 will generally have elastomeric qualities to it for flexibility and in some cases may even have intumescent qualities. In traditional stuff and spray assemblies, the fire spray 112 will go over the mineral wool 110 and lap over the top edge of the wall board 50, for example, by about ½ inch.

An aspect of the present invention involves the realization that because the fire spray 112 extends over two dissimilar materials, i.e., the mineral wool 110 which is compressible and wall board (e.g., drywall) 50 which is rigid, a great deal of stress is created in the fire spray 112 covering the deflection gap as both materials will act differently as they are cycled up and down. The mineral wool 110 is flexible and will be more forgiving as it cycles, but the drywall 50 is rigid and will pull away from the mineral wool 110 and fire spray 112. Therefore, as these assemblies go through the movement cycle test of UL 2079, the fire spray tends to rip or tear along the joint between the drywall and the mineral wool. Cracks, rips, or tears create a weak spot in the joint and it becomes very vulnerable to the air-leakage test and burn test that follow the movement cycle test according to UL 2079. However, in the arrangement illustrated in FIG. 2, it is apparent that the fire spray 112 only laps on the angle 20. The wall board (e.g., drywall) 50 is able to cycle unencumbered against angle 20 without stress cracks to the fire rated deflection joint. Such an arrangement is capable of providing a Class III Seismic movement joint according to UL 2079.

The header track 42 is secured to the ceiling 44 by a suitable fastener (e.g., concrete fastener). If the wall assembly 40 includes a dynamic head-of-wall, a gap may be present between upper ends of the wall studs 46 and wall board 50 to allow relative movement therebetween, as shown. The horizontal leg 22 of each angle 20 is interposed between the web of the header track 42 and the ceiling 44 such that the angles 20 are held in place by the header track 42. Compression of the portion of the intumescent strip 30 positioned on the horizontal leg 22 can assist in securing the angle 20 between the header track 42 and the ceiling 44 and inhibiting or preventing undesired removal of the angle 20. The vertical leg 25 of the angle 20 is interposed between the side leg of the header track 42 and the wall board 50. That is, the vertical leg 25 of the angle 20 is positioned on the inside of the wall board 50, which provides an attractive finished head-of-wall joint.

Advantageously, such an arrangement permits the use of a separate component (i.e., the angle 20) to carry the intumescent strip 30 instead of the intumescent strip 30 being placed directly on the header track 42 and also permits the angle 20 to be placed inside the wall board 50. The use of a separate component (angle 20) to carry the intumescent strip 30 can be advantageous because shipping and storage of the angle 20 without damaging the intumescent strip 30 is simplified relative to when the intumescent strip 30 is carried by the header track 42. For example, the angles 20 can be easily stacked and shipped in a box, whereas it is more difficult to stack and ship a header track 42 incorporating intumescent strip(s) 30. In addition, the use of a separate component (angle 20) to carry the intumescent strip 30 allows a fire-rated head-of-wall joint to be created with nearly any type or brand of header track 42 (or other components).

The angle(s) 20 can be installed before, during or after installation of the header track 42. If separate fasteners or fastening methods are used, the angle(s) 20 could be affixed to the ceiling 44 separately and prior to the installation of the header track 42. However, preferably, the angle(s) 20 is/are installed during or after installation of the header track 42. The angle(s) 20 can be placed on the header track 42 and then held in place against the ceiling 44 as the header track 42 is secured to the ceiling 44. Alternatively, the angle(s) 20 can be affixed to the header track 42, even if temporarily (e.g., using an adhesive or caulk), and then the header and angle(s) 20 can be secured to the ceiling 44. Or, the angle(s) 20 can be installed after the header track 42 is partially or completely installed. For example, the header track 42 can be secured to the ceiling 44 with a minimum number of fasteners, the angle(s) 20 installed, and then the remaining fasteners can be installed to secure the header track 42 to the ceiling 44. Alternatively, the header track 42 can be completely installed and then the angle(s) 20 can be inserted between the header track 42 and the ceiling. The edges of the header track 42 can be slightly flexed to allow insertion of the horizontal leg 22 of the angle 20. The angle(s) 20 can be lightly tapped or otherwise pressed into place. If desired, a spacer (e.g., washer or embossment on the upper surface of the track 42) can be positioned between the ceiling 44 and the header track 42 to create a small gap (preferably smaller than the combined thickness of the horizontal leg 22 and intumescent strip 30) to facilitate insertion of the angle(s) 20. Additional fasteners can be installed through both the header track 42 and angle 20, if desired.

As described, when the angle piece 20 is installed over the leg of the framing member it creates a sacrificial layer of fire protection. The steel angle will absorb heat but it will not melt in a standard fire. Therefore, the actual steel framing members will not be exposed to the direct line of a fire.

The steel angle piece 20 can be used in conjunction with other arrangements and methods of fire rated joint assemblies such as fire spray 112 that is used to seal off mineral wool 110 placed in fluted pan decks that have walls running perpendicular. The fire spray or fire sealant 112 could be installed over the mineral wool 110 and then overlap onto the steel angle piece 20 to create a fire, smoke or sound seal from irregular pan decking. The steel angle piece 20 could be used on concrete or roof pan decking construction.

With solid concrete construction, the steel angle piece 20 could be used by itself being installed over the leg of the framing member. Once the drywall is installed over framing members, the steel angle piece 20 is locked in place and will not become dislodged. The steel angle piece 20 does not require mechanical fasteners as the small leg 22 creates a friction fit once installed over the framing member. However, in some arrangements, mechanical fasteners or other fastening or friction-enhancing features may be used, such as those disclosed in Applicant's U.S. Pat. No. 8,595,999.

Figure 3:
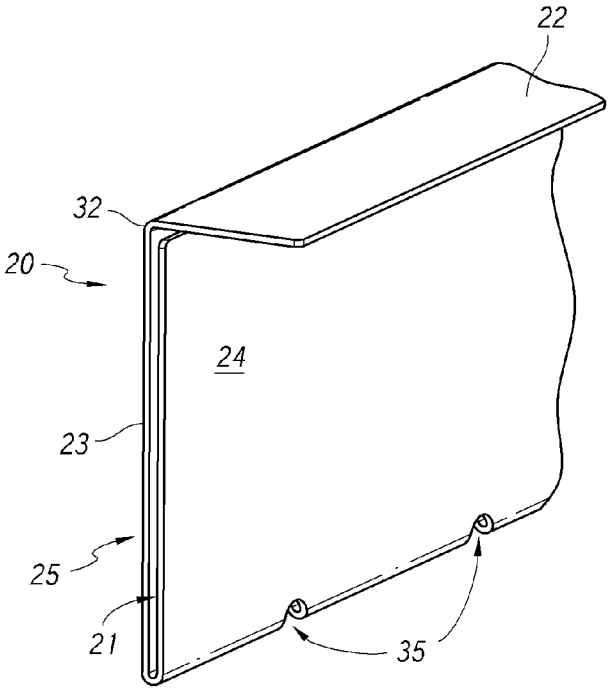
FIG. 3 illustrates a perspective view of another fire-block angle piece having a vent.
Figure 4:
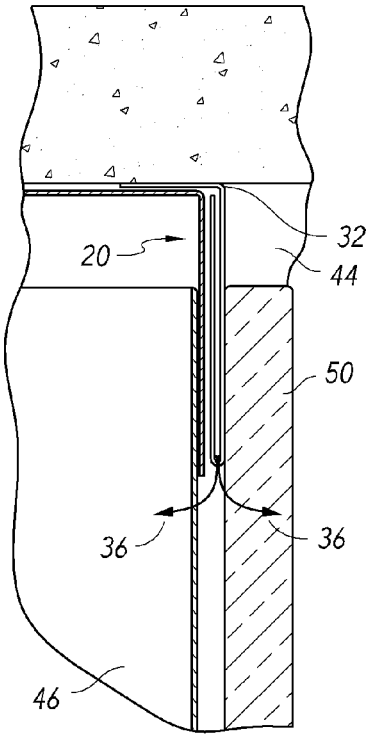
FIG. 4 illustrates a cross-sectional view of a head-of-wall joint incorporating the fire-block angle piece of FIG. 3.

With reference to FIGS. 3 and 4, a fire-block angle piece with a plurality of vent holes is illustrated alone and as part of a head-of-wall assembly. FIG. 4 illustrates a head-of-wall assembly 40 similar to that shown in and described with reference to FIG. 2. Accordingly, the same reference numbers are used to describe the same or corresponding components. The insulation space 21 between adjacent layers of the angle piece 20 can be provided with one or more vents 35 to allow heat to escape preferably in a somewhat controlled or restricted manner and/or at specific locations. For example, a plurality of vent holes 35 can be provided at the bottom in the center of the fold forming the vertical leg portion 25. This arrangement allows heat to escape at the bottom of the angle piece 20 rather than the inside corner 32 near the top where the structures are mostly or entirely metal. Allowing heat to vent at the bottom will divert the heat into the wallboard or drywall where it can be absorbed into the wallboard or drywall.

As described, the steel angle piece 20 can be or comprise a "sacrificial layer" to protect the wall framing members. When fires are present, the perimeter joints are vulnerable to heat, smoke or flame passage from one side of the wall to the other. The steel angle piece provides a sacrificial layer in which the heat can be absorbed into the steel angle piece rather than being absorbed into the framing members.

Many different configurations of a steel angle piece can be used, such as a single leg with an embossed pattern to create an insulation space(s) between the angle piece and the framing members (e.g., a ⅛" deep corrugated horizontal pattern) or the double layer steel leg.

As discussed above, the angle piece 20 may be formed from one unitary piece through bending or another suitable process. With reference to FIGS. 5-7, a bead of fire sealant 33 or other fire resistant material can be applied to the top inside corner 32 of the angle piece 20 just prior to the final bend so that the two legs 23, 24 will be sealed together. Such an arrangement can seal an upper end of the insulation space 21 to force more heat down through the vent holes 35. Such an arrangement can be constructed by any suitable process, such as making a first bend in a work piece to create a first leg portion 22 and a second leg portion 25 (forming the corner 32), applying a fire sealant 33 (or other suitable material) at or near the bend or corner 32 and bending the second leg portion 25 to create a two (or more) layer second leg in which the fire sealant 33 is positioned between and contacts each of a first layer and a second layer of the second leg. The actions or steps identified above can be carried out in the order described or in any other suitable order.

Figure 8:
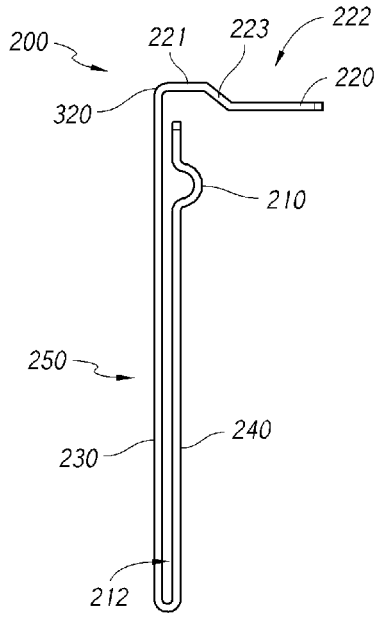
FIG. 8 illustrates a cross-sectional view of yet another fire-block angle piece having a stand-off rib or protrusion and a gap-filling feature.
Figure 9:
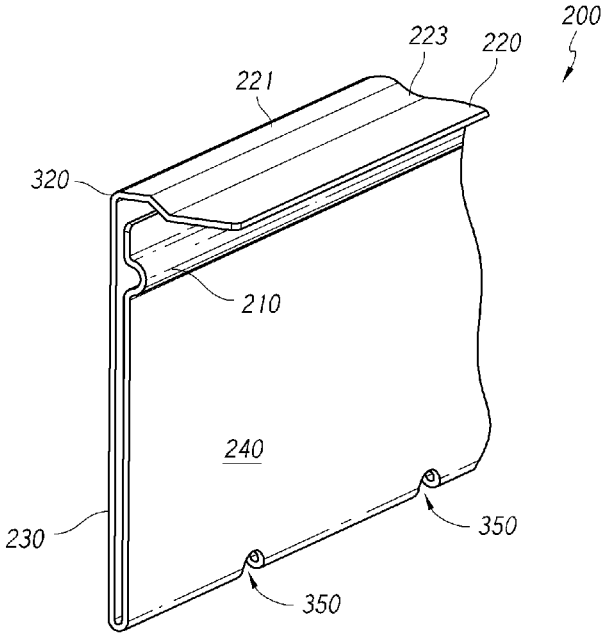
FIG. 9 illustrates a perspective view of the fire-block angle piece of FIG. 8.
Figure 10:
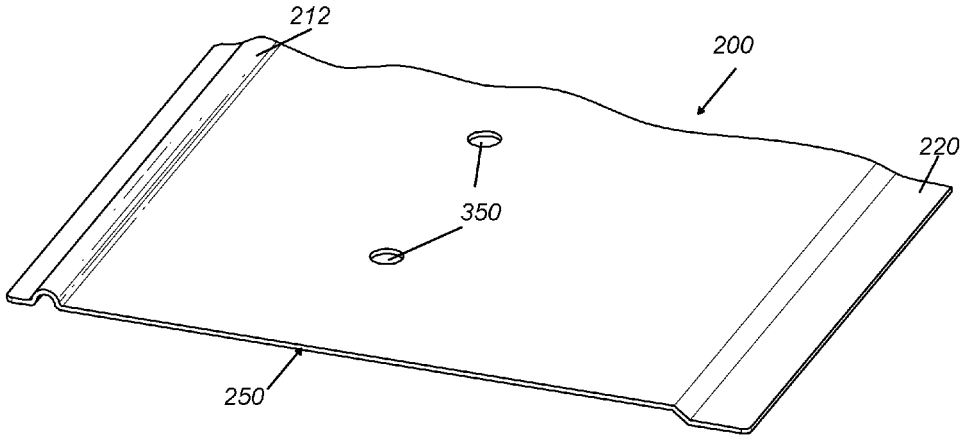
FIG. 10 illustrates the fire-block angle piece of FIG. 8 in one state of manufacture.
Figure 11:
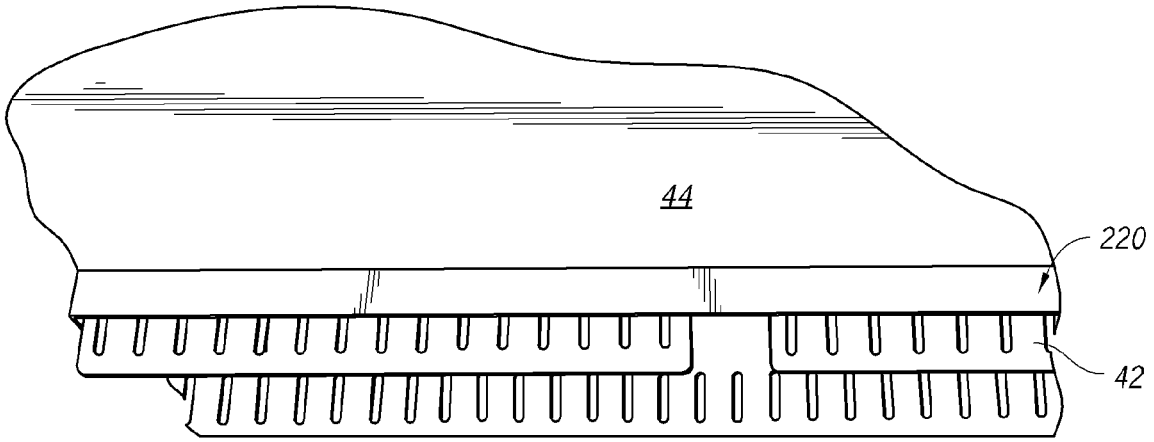
FIG. 11 illustrates an example of a fire-block angle piece installed with a slotted header track.

With reference to FIGS. 8-10, in some configurations, the angle piece can comprise additional features to facilitate installation, retention or operation. For example, the angle piece 200 can comprise a protrusion or rib 210 on the inside leg 240 of the lower leg 250 so that the angle piece 200 will not be completely tight against the header track. This arrangement spaces the angle piece 200 away from the header track to create a fastener space that allows the framing screws to cycle up and down alongside the angle piece 200 without getting stuck on the lower edge of the leg of the angle piece. Such an arrangement can be advantageous for angle pieces having a relatively short vertical leg in which the fasteners may be positioned below the vertical leg in at least some relative deflection positions between the wall and the overhead structure (e.g., relatively open positions). Such a short leg angle piece 200 is illustrated in FIG. 11. In the illustrated arrangement, the angle piece 200 covers only a portion (e.g., about half) of the slotted leg of the header track 42. This arrangement allows the builder to install the framing studs before or after the steel angle is installed because the bottom half of the slots remain accessible. Providing access to the slots means the studs can be installed at any time because the framing screws are installed through the slot and into the stud.

With continued reference to FIGS. 8 and 9, in some configurations, the horizontal leg 220 of the angle piece 200 can be made in different styles to provide a way to secure the leg 220 between the header track 42 and the ceiling 44 and inhibiting or preventing inadvertent or undesired removal of the angle 200. As described above, the angle piece 200 can comprise a feature that facilitates sealing of the gap between the header track and the overhead structure. The overhead structure, which can be a fluted deck pan or a concrete structure, for example, rarely has a perfectly flat bottom surface. As a result, intermittent gaps can exist between the overhead structure and a header track that is secured to the overhead structure. To partially or completely fill such gaps, the angle piece 200 can comprise a fold, bend, rib, protrusion or other structure that increases the thickness of the horizontal leg of the angle piece above the thickness of the work piece from which the angle piece is constructed. In the illustrated arrangement, the upper or horizontal leg comprises a bend that creates offset sections of the upper leg. In some configurations, the angle piece 200 is constructed from 25 ga steel, which is relatively soft and flexible. The offset or thickened upper leg can improve the gap filling and/or sealing characteristics of the angle piece. In some configurations, the angle piece is able to create a tight seal once installed for arrangements having normal tolerances. For example, the horizontal leg 220 can include surfaces of varying height to increase the friction or interference fit between the angle 200 and the ceiling 44. The horizontal leg 220 can comprise a first surface 221 and a second surface 222 connected to the first surface 221 by a slanted surface 223, wherein the second surface 222 is offset from (e.g., lower than) the first surface 221. In some configurations, the first surface 221 can have a length of approximately ¼ inch or less. In some configurations, the second surface 222 is approximately ⅛ inch or less lower than the first surface 221.

With reference to FIG. 10, the angle piece 200 is shown in one state of manufacture. In some configurations, as shown in FIG. 10, the vertical leg 250 can comprise a plurality of holes 350 with the center of the holes approximately 2½ inches from the lower edge of the vertical leg 250 prior to bending the material to form the vertical leg 250. The vertical leg 250 can be bent in a lengthwise direction at a location aligned with the holes 350 (e.g., the center of the holes 350). The holes 350 can provide venting to the space between the inside leg 240 and the outside leg 230 of the vertical leg 250.

Figure 12:
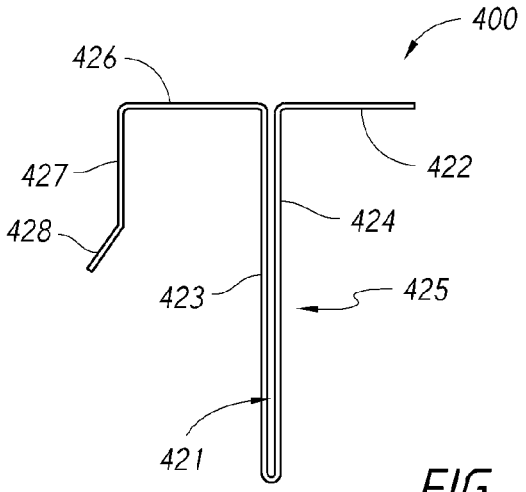
FIG. 12 illustrates a cross-sectional view of yet another fire-block angle piece with a T profile.
Figure 13:
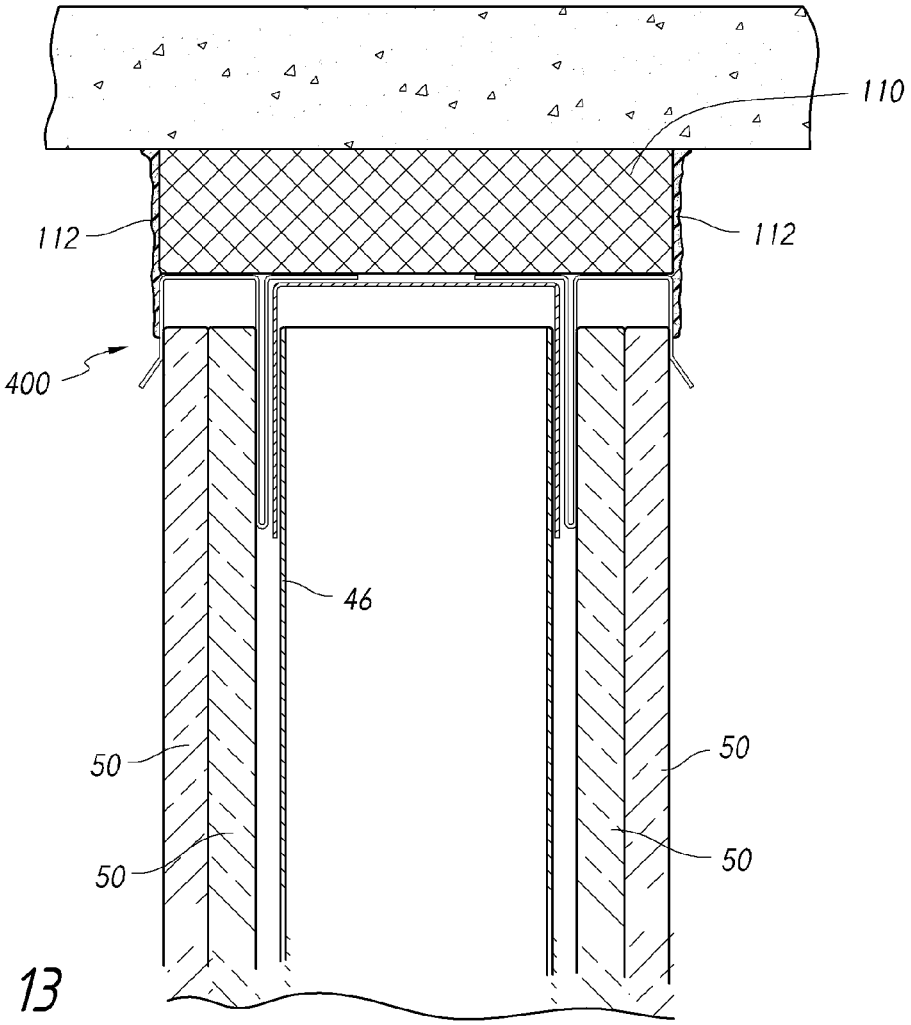
FIG. 13 illustrates a cross-sectional view of a head-of-wall assembly incorporating the fire-block angle piece of FIG. 12.

With reference to FIGS. 12 and 13, some angle configurations can have a T-shaped profile. FIG. 13 illustrates a head-of-wall assembly 40 similar to that shown in and described with reference to FIG. 2 in which a metal stud framed wall is attached to a solid concrete deck. Accordingly, the same reference numbers are used to describe the same or corresponding components. The angle piece 400 illustrated in FIGS. 12 and 13 is similar to the angle piece 20 and angle piece 200 discussed above but includes an additional horizontal leg 426 and vertical leg 427 with an optional kick out portion 428 that aligns with the finish drywall. The horizontal leg 422 can be an optional friction fit leg that can be removed in some configurations. The outer vertical leg 427 can serve three purposes. One, performance of UL 2079 fire tests with unencumbered or unfilled joints can prove difficult to pass because the header track can heat up quickly when they are exposed to a fire. The outer leg 427 of the T profile angle piece 400 can prevent direct heat exposure to the header track giving the head-of-wall joint assembly added protection. Two, the outer leg 427 of the T profile angle piece 400 can hold the drywall in place during the fire test (as shown in FIG. 13) as it will exert pressure against the outer layer of drywall 50 which in return will aid in keeping the drywall in place during a fire test. Three, the outer leg 427 can receive fire spray 112 which can be applied over the mineral wool 110 and lap on to the outer leg 427 above the kick out portion 428. This is an important feature because it allows the fire spray to be installed prior to the drywall installation. These types of firestopping joint systems are known as pre-manufactured firestopping joints and they allow the firestopping to be completed before other trades come in with their MEP's (mechanical, electrical, and plumbing). Pre-manufactured firestopping can be done at a fraction of the labor and is more likely to be properly installed because there is more room to work in the absence of the MEP's.

Figure 14:
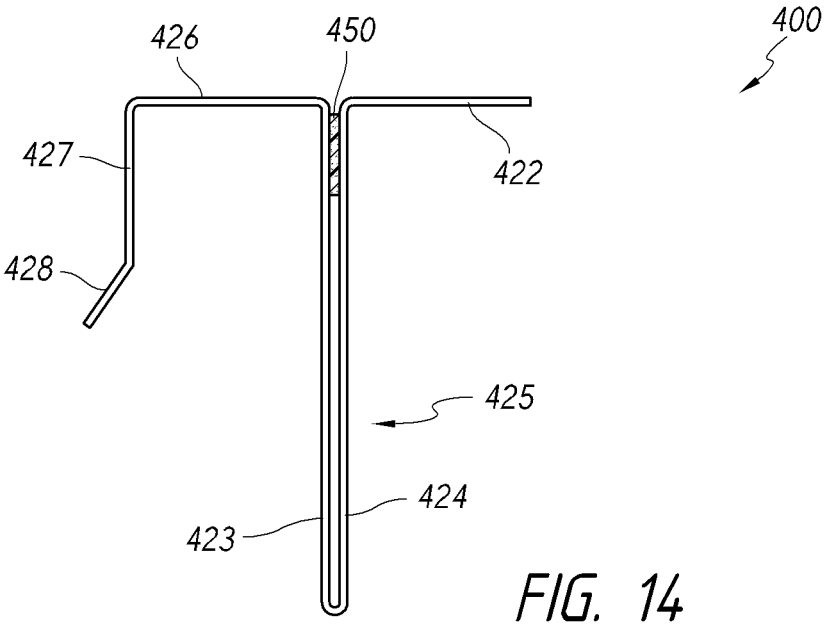
FIG. 14 illustrates a cross-sectional view of yet another fire-block angle piece having an intumescent material between the layers of the layered leg.

With continued reference to FIGS. 12 and 13, the angle piece 400 can include two flange layers of steel (legs 423 and 424) to create an air gap 421 so that heat is decoupled from one layer of steel to the other. In other words, heat transfer directly between the flange layers 423, 424 is inhibited. In FIG. 12, there is no firestopping or fire retardant material between the flange layers 423, 424. Although not specifically shown, the layers 423, 424 can have a rib or corrugation on one or both of the inside leg 424 and the outside leg 423. The rib can provides a separation gap between the layers 423, 424. Alternatively, as shown in FIG. 14, there is also an option to apply a fireblock material 450, such as an intumescent material, for example, intumescent paint, on the inside of the vertical leg 423 prior to bending the steel over so that the intumescent material is layered between the layers of steel. Other types of intumescent materials (e.g., foamed strips) can also be used. In some configurations, at the upper portion of the vertical leg 423 the steel is bent so that it closes off the open end to restrict heat from escaping. Although not specifically illustrated, the angle piece 400 can be secured to the header track 42 by a suitable connector, such as (e.g., threaded) fasteners 48.

Figure 15:
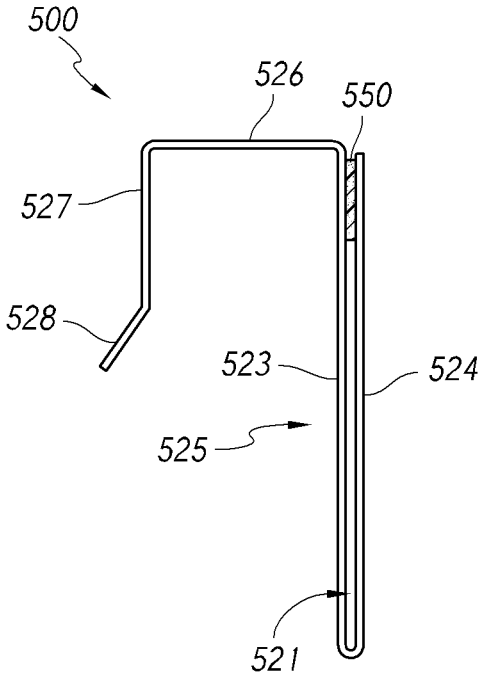
FIG. 15 illustrates a cross-sectional view of yet another fire-block angle piece having a J profile.
Figure 16:
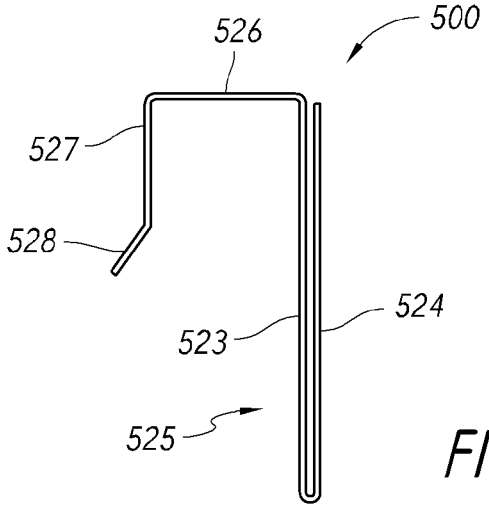
FIG. 16 illustrates a cross-sectional view of another fire-block angle piece with a J profile.
Figure 17:
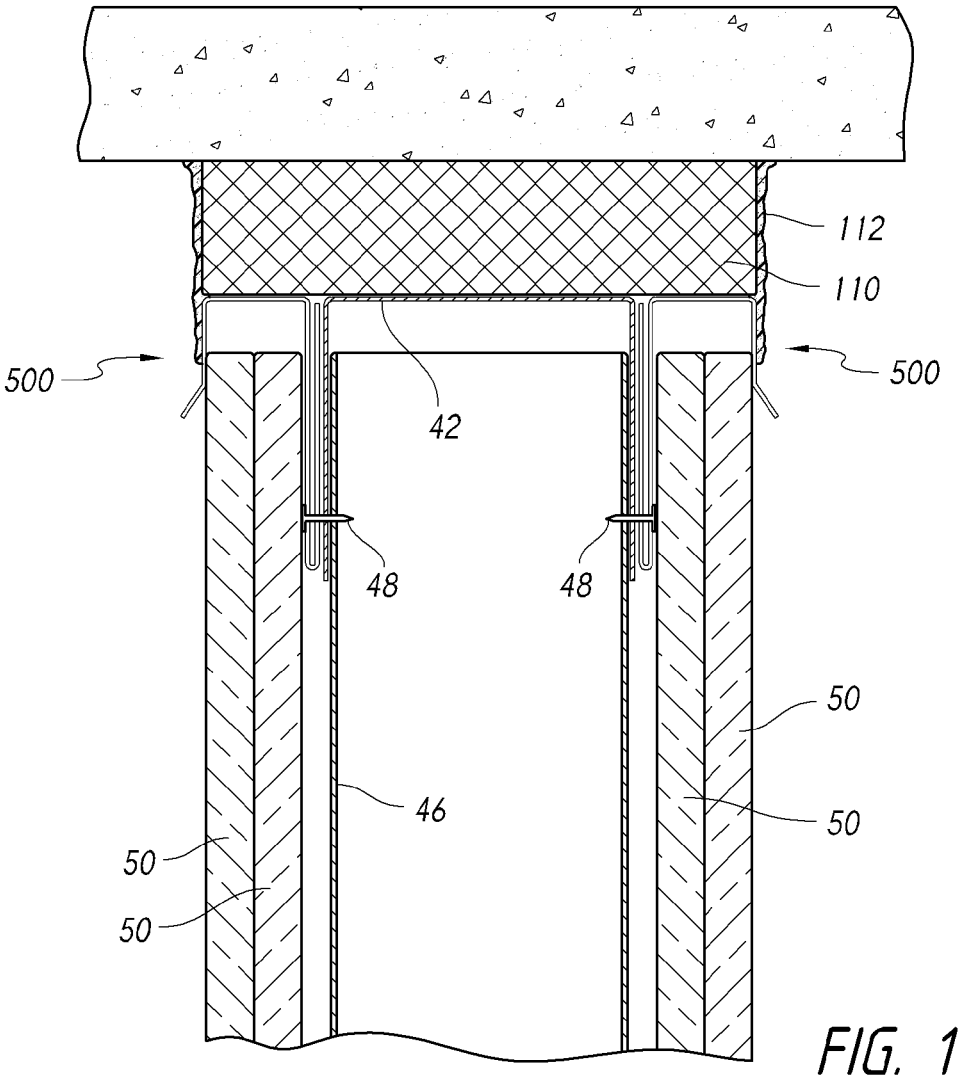
FIG. 17 illustrates a cross-sectional view of a head-of-wall assembly incorporating the fire-block angle piece of FIG. 16.

With reference to FIGS. 15-17, the angle 500 is shown with a J profile, that is, with the friction fit leg (422) removed relative to the angles 400 of FIGS. 12-14. In some configurations, an intumescent material or bead of sealant 550 may be applied to the upper portion of the multi-layer leg 525, as shown in FIG. 15. FIG. 16 illustrates a version without intumescent or other The J profile angle 500 has the same firestopping benefits as those discussed above with respect to the T profile angle. FIG. 17 illustrates a wall assembly incorporating the J profile angle 500 with a kickout portion 528 that extends outward from a double layer of drywall 50. The J profile angle 500 can be fastened to the header track 42 using any type of suitable fastener 48 that passes through the multi-layer leg 525 of the J profile angle 500 into the leg of the header track 42.

Figure 18:
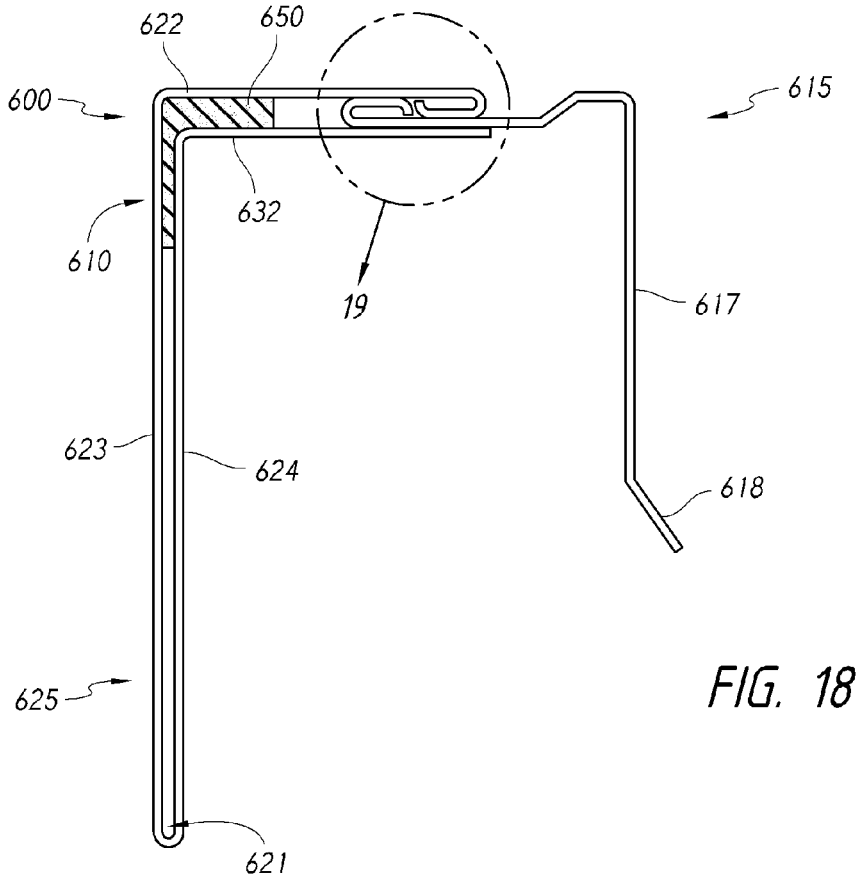
FIG. 18 illustrates a cross-sectional view of yet another fire-block angle piece assembly having two pieces connected by an interlocking portion.
Figure 19:
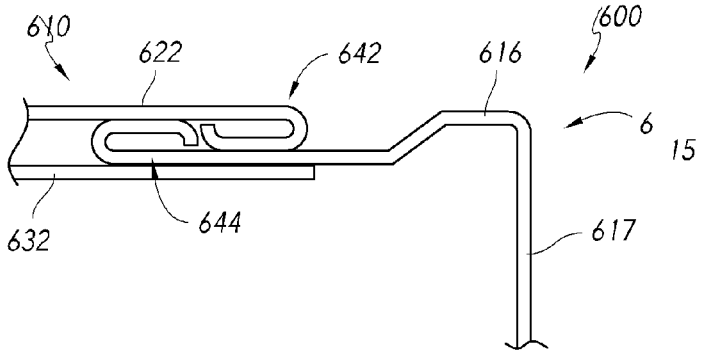
FIG. 19 illustrates a closer view of the interlocking portion of the fire-block angle piece assembly of FIG. 18.

Another configuration of an angle piece is shown in FIGS. 18 and 19. The angle piece 600 is similar to the angle pieces 20, 200, 400, and 500 discussed above. In the configuration shown in FIG. 18, the angle piece 600 can formed from two portions. One portion 610 forms the two-ply steel vertical leg portion 625 and a two-layer horizontal leg portion 622. The second portion 615 includes a vertical leg 617 and, in some configurations, a kickout portion 618. Additionally, the top or horizontal leg portion 622 of the angle 600 can have a small hem 642 that interfaces with a hem 644 on the second portion 615 of the angle piece 600. Once properly installed, the hems 642, 644 inhibit or prevent the angle 600 from being removed or slipping out due to structure vibrations or movement. Additionally, the interlocking hems 642, 644 improve ease of installation. As shown, preferably the hem 642 is a fold in the free end of the horizontal leg 622 that is positioned above the remaining, preferably planar, portion of the horizontal leg 622. Preferably, the hem 642 is substantially completely folded over; however, in other arrangements, the hem 642 may be a partial fold similar to the kick out, for example. Similarly, preferably the hem 644 is a fold in the free end of the horizontal portion 616 of the second portion 615 of the angle piece 600. The hem 644 is preferably oriented in the opposite direction (that is, the end of the horizontal portion 616 is folded upward) of the direction of the fold of the hem 642 such that the hems 642, 644 can interlock as shown in FIG. 19. The interlocking hem design illustrated in FIGS. 18 and 19 can improve installation as the second portion 615 can be installed after the drywall is installed. In some configurations, the horizontal portion 616 of the second portion 615 can comprise a fold, bend, rib, protrusion or other structure that increases the thickness of the horizontal leg of the angle piece above the thickness of the work piece from which the angle piece is constructed, as discussed above with respect to FIGS. 8 and 9.

In some configurations, the portions 610, 615 may be made from different materials to create a hybrid angle piece 600. For example, the portion 615, which can be exposed in a finished wall assembly, may be made from plastic, paper, or aluminum, among other suitable or desirable finishing materials.

With continued reference to FIG. 18, the kickout is in the form of an angled extension 618 provided on the free end of the vertical portion 617 of the second portion 615 of the angle 600. However, other arrangements of the kickout could be used (such as a block-out, hem, etc.).

Figure 20:
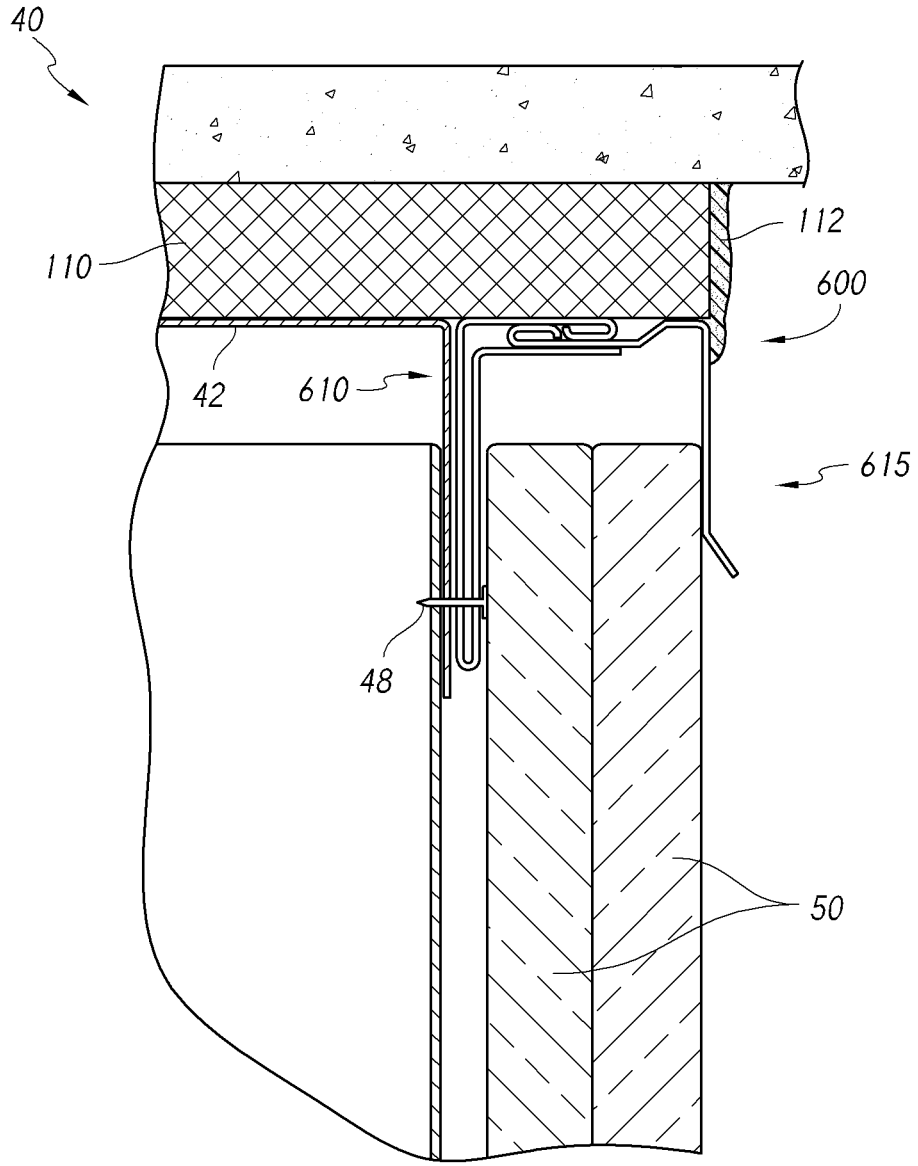
FIG. 20 illustrates a partial cross-sectional view of a head-of-wall assembly incorporating the fire-block angle piece of FIG. 18.

FIG. 20 illustrates a head-of-wall assembly 40 similar to that shown and described with reference to FIG. 2 in which a metal stud framed wall is attached to a fluted pan deck with concrete. Accordingly, the same reference numbers are used to describe the same or corresponding components. In the illustrated arrangement, optional fasteners 48 are shown being used to secure the first portion 610 of the angle 600 in place. The fasteners 48 pass through both the flange of the header track 42 and the vertical leg 625 of the angle 600. As discussed above, the second portion 615 of the angle piece 600 can be installed after drywall installation. As illustrated a layer of fire spray 112 may be applied to the top outside corner of the angle piece 600 as discussed above.

Figure 21:
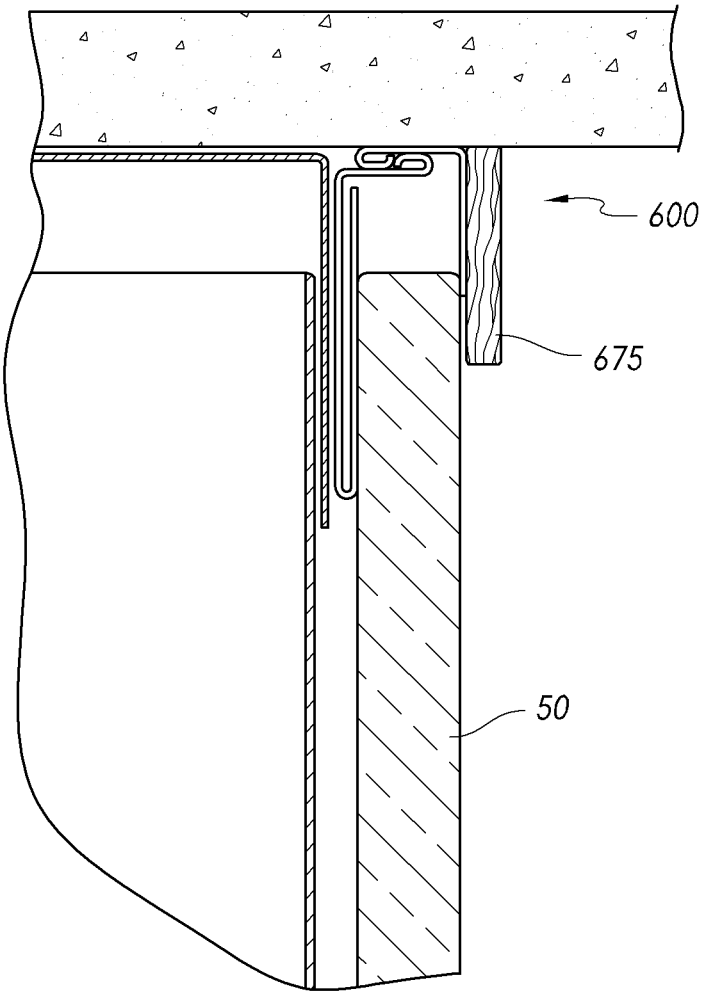
FIG. 21 illustrates a partial cross-sectional view of a head-of-wall assembly incorporating yet another two-piece fire block angle assembly with a wood trim piece.

With reference to FIG. 21, another configuration of an angle piece 600 is shown with a wood trim 675 attached to the outside-facing leg 617. The wood trim 675 provides a decorative aspect that can conceal the angle piece 600 and provide a more aesthetically-pleasing construction. Although not specifically illustrated, the angle piece 600 can be secured to the header track 42 by a suitable connector, such as (e.g., threaded) fasteners 48.

Figure 22:
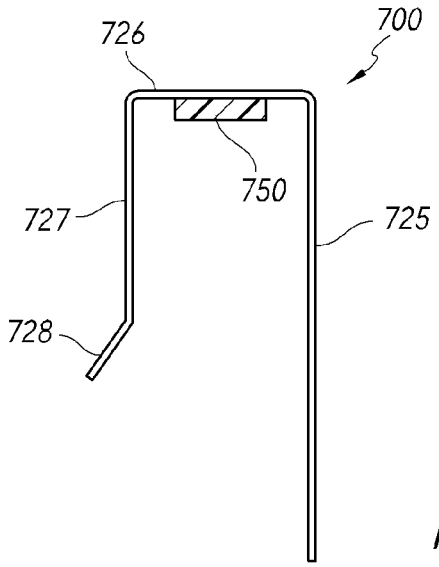
FIG. 22 illustrates a cross-sectional view of yet another fire-block angle piece having an intumescent material applied to the inner surface of the horizontal leg.
Figure 23:
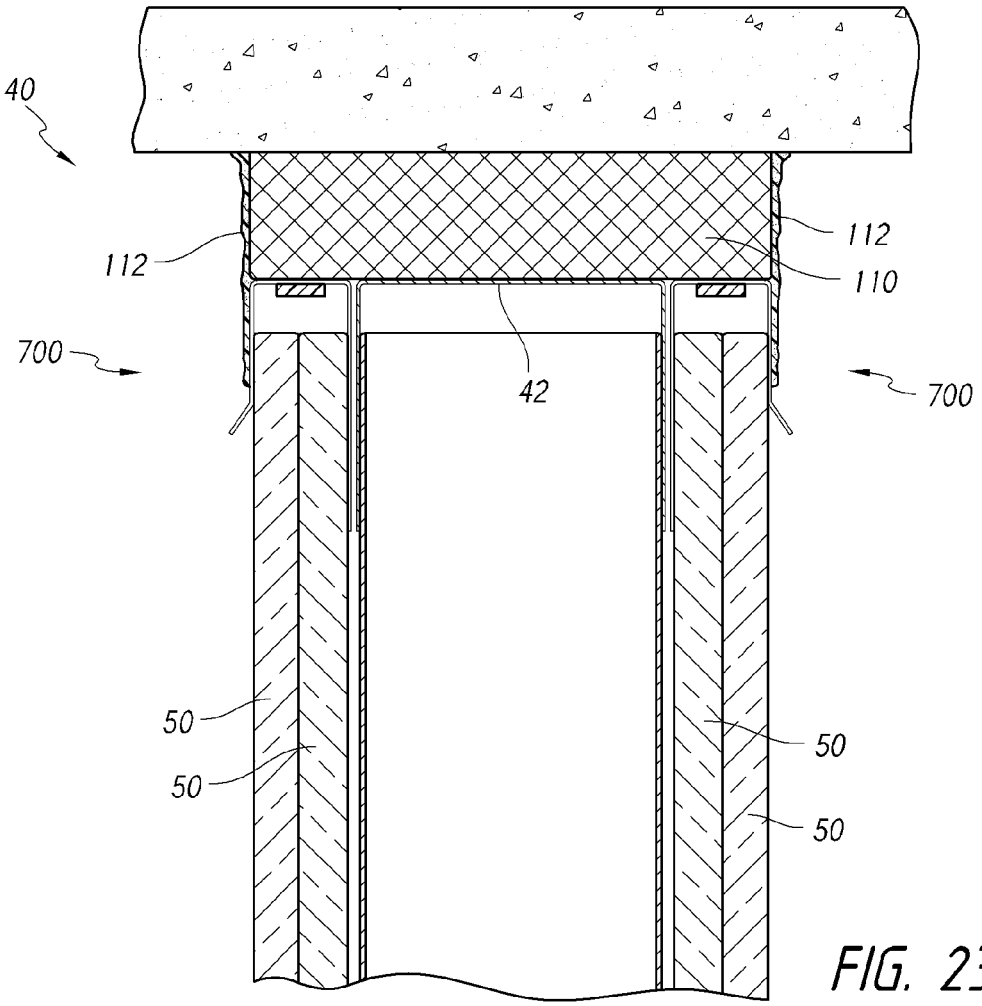
FIG. 23 illustrates a cross-sectional view of a head-of-wall assembly incorporating the angle piece of FIG. 22.

With reference to FIGS. 22 and 23, another J-profile angle piece 700 is illustrated both alone and as part of a head-of-wall assembly. In this configuration, the angle piece 700 includes an intumescent material 750, such as tape, that is applied to the inner surface of the horizontal leg 726. The angle piece 700 has a single vertical leg 725 instead of a multi-layer vertical leg as discussed above with respect to other configurations. The angle piece 700 also includes an outside vertical leg 727 with an optional kickout portion 728. The head-of-wall assembly 40 shown in FIG. 23 is similar to that shown in and described with respect to FIGS. 2 and 13 in which a metal stud framed wall is attached to a solid concrete deck. Accordingly, the same reference numbers are used to describe the same or corresponding components. Although not specifically illustrated, the angle piece 700 can be secured to the header track 42 by a suitable connector, such as (e.g., threaded) fasteners 48.

Figure 24:
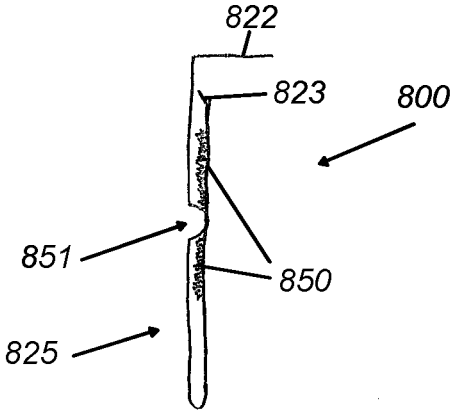
FIG. 24 illustrates a cross-sectional view of yet another fire-block angle piece having an inward facing rib on the outside layer of the vertical leg.

With reference to FIG. 24, another fire-block angle piece 800 is illustrated. The fire-block angle piece 800 includes an inward rib corrugation 851 on the outside leg of the vertical leg 825. The rib 851 provides a separation gap between the two flange layers of steel of the leg 825 to create an air gap so that heat is decoupled from one layer of steel to the other. In other words, heat transfer directly between the flange layers of the vertical leg 825 is inhibited. There is also an option to apply an intumescent material 850, such as an intumescent paint, on the inside leg prior to bending the steel to create the multiple layer vertical leg 825 so that the intumescent material 850 is layered between the layers of steel of the vertical leg 825. Other types of intumescent materials (e.g., foamed strips) can also be used. In some configurations, the upper portion 823 of the inside leg of the vertical leg 825 is bent so that it closes off the open end of the vertical leg 825 to restrict heat from escaping.

Figure 25:
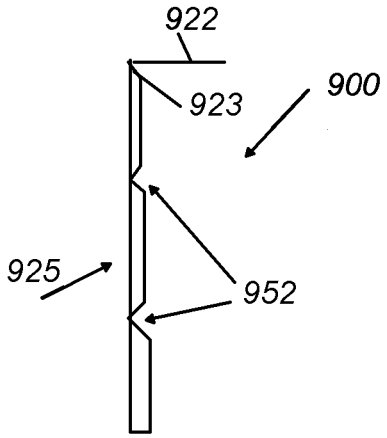
FIG. 25 illustrates a cross-sectional view of yet another fire-block angle piece having at least one inward facing rib on inside layer of vertical leg.

With reference to FIG. 25, another fire-block angle piece 900 is illustrated. The fire-block angle piece 900 includes an arrangement in which the inside layer of steel forming the vertical leg 925 includes one or more corrugated ribs 952 pre-formed into the steel so that it creates a separation between the two layers of steel forming the vertical leg 925, for the same or similar reasons as discussed above.

Figure 26:
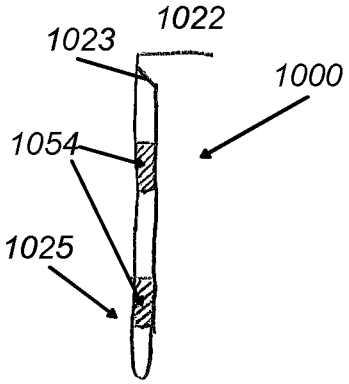
FIG. 26 illustrates a cross-sectional view of yet another fire-block angle piece having beads of sealant to create separation between the layers of the vertical leg.

With reference to FIG. 26, another fire-block angle piece 1000 is illustrated. The fire-block angle piece 1000 includes or more beads of sealant 1054 that can be used in between the two layers of steel forming the vertical leg 1025 to create a separation air gap between the layers of steel. Any suitable type of sealant or heat resistant material may be used to create the separation.

Figure 27:
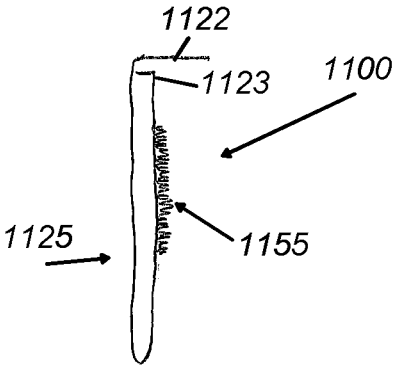
FIG. 27 illustrates a cross-sectional view of yet another fire-block angle piece having a 90 degree bend to create separation between the layers of the vertical leg.

With reference to FIG. 27, another fire-block angle piece 1100 is illustrated. The fire-block angle piece 1100 includes an intumescent material 1155 or any other type of heat restrictive material that can be applied to the outer surface portion of the inside leg of the vertical leg 1125 (facing the header track) in the same location of the slots in the slotted track so that heat is less likely to pass through the open slots. In some arrangements, the inside leg of the vertical leg 1125 includes a 90 degree bend 1123 to hold apart or separate the layers of steel forming the multi-layer vertical leg 1125.

Figure 29:
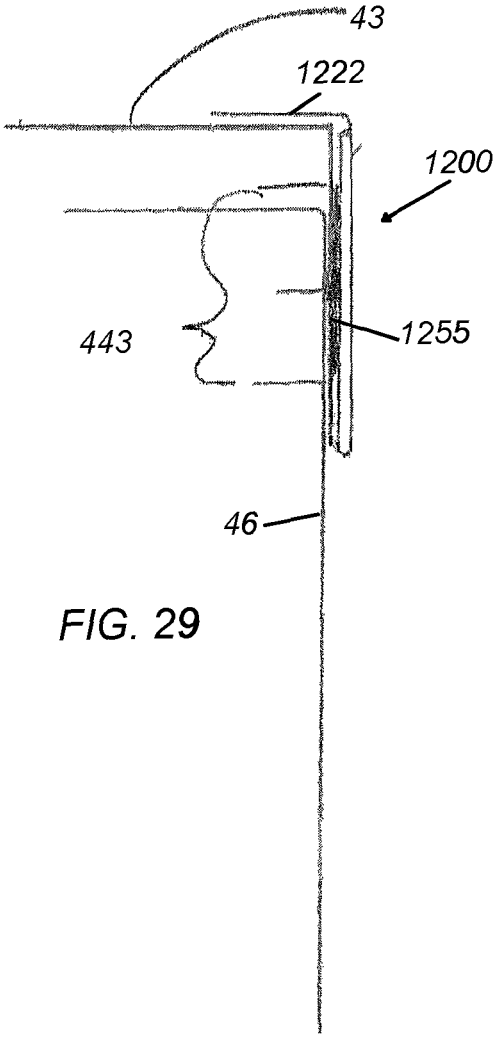
FIG. 29 illustrates a cross-sectional view of a wall assembly incorporating the fire-block angle piece of FIG. 28.
Figure 28:
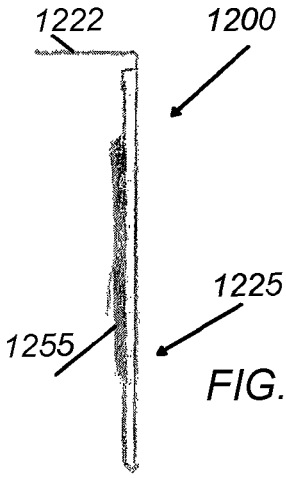
FIG. 28 illustrates a cross-sectional view of yet another fire-block angle piece having intumescent material applied on an interior surface of the multiple layer vertical leg.

With reference to FIG. 28, another fire-block angle piece 1200 is illustrated. The fire-block angle 1200 includes an intumescent material 1255 applied to an inner surface of the vertical leg 1255, as shown above in another configuration in FIG. 27. FIG. 29 illustrates a partial wall assembly incorporating the fire-block angle piece 1200 with the heat restrictive material 1255 in the location of the open slots 443 installed over the leg of the slotted track 43.

Figure 30:
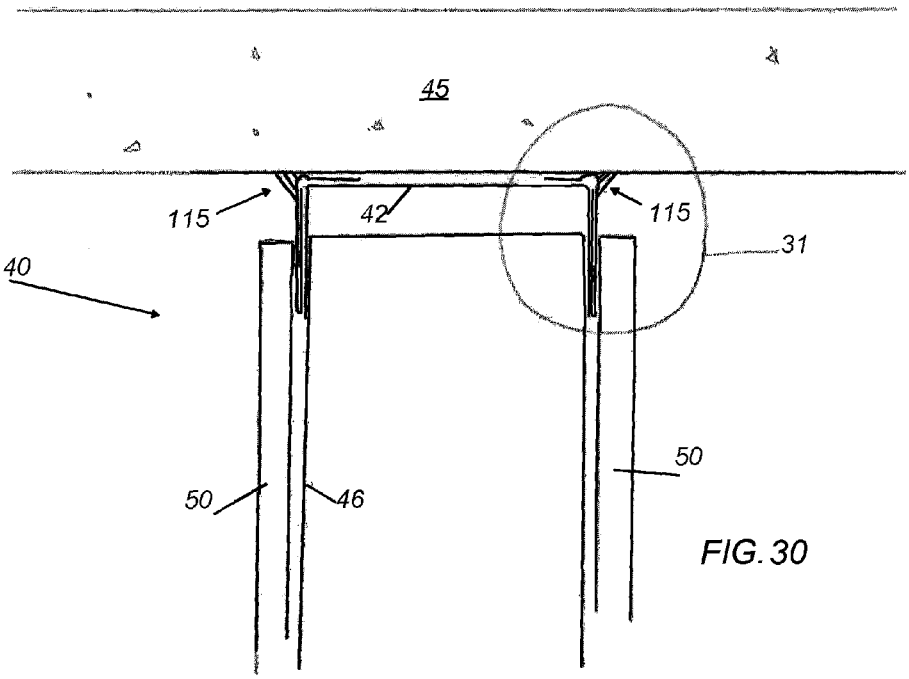
FIG. 30 illustrates a cross-sectional view of a wall assembly incorporating another embodiment of a fire-block angle piece.
Figure 31:
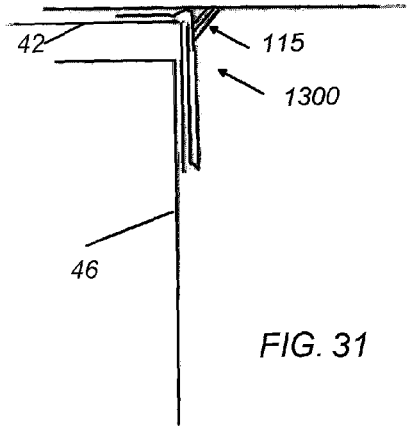
FIG. 31 illustrates a detailed cross-sectional view of the wall assembly of FIG. 30 further illustrating the fire-block angle piece and sealant.

FIG. 30 illustrates a wall assembly 40 incorporating another configuration of a fire-block angle 1300 with a solid concrete overhead slab 45. Solid concrete overhead slabs can be very inconsistent creating small gaps between the framing (header track 42 or other uppermost surface of the wall) and the concrete 45. In the event of a fire, smoke would be able to pass through these small gaps if left unattended. As shown in FIG. 30, and in closer detail in FIG. 31, a small bead of sealant 115 can be applied in the field during construction to inhibit or prevent smoke passage and create a tight seal between the fire-block angle 1300 and the overhead concrete 45. Although this type of sealant is not unique, the fact that the sealant 115 is applied to the angle piece 1300 (and not the track framing member 42) is new. The angle piece 1300 is the sacrificial layer that protects the framing member 42 as discussed in detail above.

Figure 32:
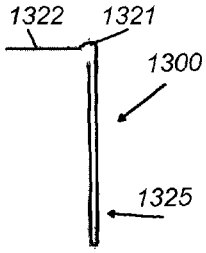
FIG. 32 illustrates a cross-sectional view of the fire-block angle piece with a corrugated rib shown in FIGS. 30 and 31.

FIG. 32 illustrates the fire-block angle piece 1300 shown in the wall assembly illustrated in FIG. 30. The fire-block angle piece 1300 includes a corrugated rib 1321 that may be smaller than previous ribs discussed above. In some configurations, the angle piece 1300 is made out of 25 ga steel, which is thin and pliable, among other advantages discussed above. When made of this material, the angle piece 1300 will conform to the concrete 45 to prevent the transfer of smoke. In some configurations, the additional sealant 115 may not be required if the corrugated rib 1321 on the horizontal leg 1322 of the angle piece 1300 is able to create a tight seal against the inconsistent overhead concrete 45.

The configurations shown in FIGS. 24-32 are similar to the configurations shown in FIGS. 1-5 and discussed above. However, in FIGS. 24-32, instead of a wall assembly including an overhead pan deck attachment, FIGS. 24-32 illustrate wall assembly configurations including a solid concrete overhead attachment. Furthermore, instead of fire spray applied over mineral wool, as shown in some of FIGS. 1-5, FIGS. 24-32 illustrate some configurations in which a small bead of sealant is applied between the angle and the concrete.

Although the multi-layer leg of the angle piece is disclosed as formed by a single piece of material herein, in other configurations, a separate piece of material can be coupled to the angle piece and utilized to create one or more additional layers and insulation spaces. Such separate piece of material can be the same material or a different material from the material of the angle piece.

Although many of the arrangements disclosed herein contain an intumescent material, the intumescent material is not required and may be omitted. Also, although the angles or other components are described as steel, other suitable materials can also be used.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A fire-rated wall joint product, comprising:

an elongated, generally L-shaped angle comprising a first flange and a second flange oriented at an angle relative to the first flange, the first flange and the second flange each having a free edge and being connected to one another along an edge that is opposite the free edges thereby defining a corner, the first flange and second flange formed from a single piece of material, wherein the second flange comprises multiple layers of the single piece of material, the second flange comprising a first layer and a second layer, the first layer being connected to the first flange along the edge, the first flange extending in a direction towards the second layer; and a seal positioned between adjacent layers of the multiple layers.

2. The fire-rated wall joint product of claim 1, wherein the first flange is a single layer, further comprising an intumescent material strip applied to the first flange.

3. The fire-rated wall joint product of claim 2, wherein a width of the intumescent material strip is less than about a width of the first flange.

4. The fire-rated wall joint product of claim 1, further comprising a plurality of vent openings communicating with an insulation space between the first and second layers of the second flange.

5. The fire-rated wall joint product of claim 4, wherein the single piece of material of the second flange has a bend, and wherein the seal is at an opposite end portion from the bend.

6. The fire-rated wall joint product of claim 1, wherein the first flange is bent to create an offset upper portion and lower portion.

7. The fire-rated wall joint product of claim 1, wherein the second flange is multi-layer and comprises a rib or protrusion along an upper portion of the inside layer such that, in use, the rib or protrusion spaces the second flange from a leg of an associated header track with which the fire-rated wall joint product is used.

8. The fire-rated wall joint product of claim 1, wherein the product is constructed from steel.

9. A fire-rated wall joint product, comprising:

an elongated, generally L-shaped angle piece comprising a first flange and a second flange oriented at an angle relative to the first flange, the first flange and the second flange each having a free edge and being connected to one another along an edge that is opposite the free edges thereby defining a corner, the first flange and second flange formed from a single piece of material, wherein the second flange comprises multiple layers of the single piece of material, the second flange comprising a first layer and a second layer, the first layer being connected to the first flange along the edge, the first flange extending in a direction towards the second layer; and a seal positioned between adjacent layers of the multiple layers, wherein the single piece of material of the first and second layers of the second flange has a bend, and wherein the seal is at an opposite end portion from the bend.

10. A fire-rated wall joint product, comprising:

an elongated, generally L-shaped component comprising a first portion and a second portion oriented at an angle relative to the first portion, the first portion and the second portion each having a free edge and being connected to one another along an edge that is opposite the free edges thereby defining a corner, the first portion and second portion formed from a single piece of material, wherein the second portion comprises multiple layers of the single piece of material, the second portion comprising a first layer and a second layer, the first layer being connected to the first portion along the edge, the first portion extending in a direction towards the second layer; and a seal positioned between adjacent layers of the multiple layers.

11. The fire-rated wall joint product of claim 10, wherein the seal comprises a fire retardant material.

* * * * *